US008845852B2

(12) United States Patent
Nakamori et al.

(10) Patent No.: US 8,845,852 B2
(45) **Date of Patent: *Sep. 30, 2014**

(54) POLISHING PAD AND METHOD OF PRODUCING SEMICONDUCTOR DEVICE

(75) Inventors: Masahiko Nakamori, Ohtsu (JP); Tetsuo Shimomura, Ohtsu (JP); Takatoshi Yamada, Ohtsu (JP); Kazuyuki Ogawa, Osaka (JP); Atsushi Kazuno, Osaka (JP); Masahiro Watanabe, Osaka (JP)

(73) Assignee: Toyo Tire & Rubber Co., Ltd., Osaka-shi (JP)

( * ) Notice: Subject to any disclaimer, the term of this patent is extended or adjusted under 35 U.S.C. 154(b) by 328 days.

This patent is subject to a terminal disclaimer.

(21) Appl. No.: 10/536,621

(22) PCT Filed: Nov. 27, 2003

(86) PCT No.: PCT/JP03/15128

§ 371 (c)(1),
(2), (4) Date: May 26, 2005

(87) PCT Pub. No.: WO2004/049417

PCT Pub. Date: Oct. 6, 2004

(65) Prior Publication Data

US 2006/0037699 A1 Feb. 23, 2006

(30) Foreign Application Priority Data

| | | |
|---|---|---|
| Nov. 27, 2002 | (JP) | 2002-343199 |
| Jan. 6, 2003 | (JP) | 2003-000331 |
| Feb. 6, 2003 | (JP) | 2003-029477 |
| Mar. 11, 2003 | (JP) | 2003-064653 |

(51) Int. Cl.

| | |
|---|---|
| ***C23F 1/00*** | (2006.01) |
| ***B24B 37/20*** | (2012.01) |
| ***B24B 37/013*** | (2012.01) |

(52) U.S. Cl.

CPC ..... *B24B 37/205* (2013.01); *B24B 37/013* (2013.01)

USPC ..... 156/345.15; 156/345.12; 156/345.13

(58) Field of Classification Search

USPC ..... 156/345, 345.12, 345.13, 345.15; 451/6

See application file for complete search history.

(56) References Cited

U.S. PATENT DOCUMENTS

| | | | | |
|---|---|---|---|---|
| 4,842,678 | A * | 6/1989 | Noro et al. | 216/88 |
| 4,847,150 | A * | 7/1989 | Takeda | 428/318.8 |

(Continued)

FOREIGN PATENT DOCUMENTS

| | | |
|---|---|---|
| EP | 1 176 630 A1 | 1/2002 |
| EP | 1 293 297 A1 | 3/2003 |

(Continued)

OTHER PUBLICATIONS

Article on "Chemistry of Epoxies, Epoxy Resin, Novolacs, and Polyurethanes" by Two Part Epoxy Resin Systems, publication date known.*

(Continued)

*Primary Examiner* — Sylvia R MacArthur

(74) *Attorney, Agent, or Firm* — Knobbe Martens Olson & Bear LLP

(57) ABSTRACT

A polishing pad enabling a highly precise optical endpoint sensing during the polishing process and thus having excellent polishing characteristics (such as surface uniformity and in-plane uniformity) is disclosed. A polishing pad enabling to obtain the polishing profile of a large area of a wafer is also disclosed. A polishing pad of a first invention comprises a light-transmitting region having a transmittance of not less than 50% over the wavelength range of 400 to 700 nm. A polishing pad of a second invention comprises a light-transmitting region having a thickness of 0.5 to 4 mm and a transmittance of not less than 80% over the wavelength range of 600 to 700 nm. A polishing pad of a third invention comprises a light-transmitting region arranged between the central portion and the peripheral portion of the polishing pad and having a length (D) in the diametrical direction which is three times or more longer than the length (L) in the circumferential direction.

11 Claims, 4 Drawing Sheets

(56) References Cited

U.S. PATENT DOCUMENTS

| | | | | |
|---|---|---|---|---|
| 5,069,002 | A | 12/1991 | Sandhu et al. | |
| 5,081,421 | A | 1/1992 | Miller et al. | |
| 5,196,353 | A | 3/1993 | Li et al. | |
| 5,559,428 | A | 9/1996 | Li et al. | |
| 6,171,181 | B1 * | 1/2001 | Roberts et al. | 451/527 |
| 7,192,340 | B2 * | 3/2007 | Ono et al. | 451/526 |
| 2002/0042243 | A1 | 4/2002 | Ihsikawa et al. | |
| 2002/0127950 | A1 | 9/2002 | Hirose et al. | |
| 2002/0197871 | A1 | 12/2002 | Hirose et al. | |
| 2003/0129931 | A1 | 7/2003 | Konno et al. | |
| 2004/0157985 | A1 * | 8/2004 | Masui et al. | 524/589 |
| 2004/0235392 | A1 | 11/2004 | Ohta | |
| 2005/0064709 | A1 * | 3/2005 | Shimomura et al. | 438/689 |
| 2006/0148391 | A1 * | 7/2006 | Ono et al. | 451/526 |
| 2006/0280929 | A1 * | 12/2006 | Shimomura et al. | 428/304.4 |
| 2007/0190905 | A1 * | 8/2007 | Shimomura et al. | 451/29 |

FOREIGN PATENT DOCUMENTS

| | | | | |
|---|---|---|---|---|
| JP | 55-106769 | | 8/1980 | |
| JP | 7-135190 | | 5/1995 | |
| JP | 9-7985 | | 1/1997 | |
| JP | 9-36072 | | 2/1997 | |
| JP | 10-83977 | | 3/1998 | |
| JP | 11-77517 | | 3/1999 | |
| JP | 11-512977 | | 11/1999 | |
| JP | 2000-254860 | A | 9/2000 | |
| JP | 2000-349053 | | 12/2000 | |
| JP | 2001-88013 | A | 4/2001 | |
| JP | 2001-261874 | A | 9/2001 | |
| JP | 2001-287158 | | 10/2001 | |
| JP | 2001-358101 | A | 12/2001 | |
| JP | 2002-1647 | | 1/2002 | |
| JP | 2002-9025 | | 1/2002 | |
| JP | 2002-75933 | A | 3/2002 | |
| JP | 2002-124496 | A | 4/2002 | |
| JP | 2002-192456 | A | 7/2002 | |
| JP | 2002-194047 | A | 7/2002 | |
| JP | 2002-224947 | | 8/2002 | |
| JP | 2002-324769 | A | 11/2002 | |
| JP | 2002-324770 | A | 11/2002 | |
| JP | 2002-371121 | A | 12/2002 | |
| JP | 2003-48151 | A | 2/2003 | |
| JP | 2003048151 | A * | 2/2003 | B24B 37/00 |
| JP | 2003-68686 | A | 3/2003 | |
| JP | 2003-133270 | A | 5/2003 | |

OTHER PUBLICATIONS

Machine generated English Translation of JP 2003048151A published Feb. 2003.*

Office Action issued by Japanese Patent Office on May 6, 2010 for the counterpart Japanese Patent Application No. 2004-069423.

Office Action issued by Japanese Patent Office on May 6, 2010 for the counterpart Japanese Patent Application No. 2004-069498.

Office Action issued in Korean Application No. 10-2005-7009545 on Oct. 5, 2010.

Office Action issued by the Japanese Patent Office on Sep. 8, 2010 for the counterpart Japanese Patent Application No. 2004-069423.

Office Action issued by the Japanese Patent Office on Sep. 8, 2010 for the counterpart Japanese Patent Application No. 2004-069498.

Office Action issued by the Japanese Application No. 2004-030934 on Nov. 16, 2010.

Office Action dated Jul. 26, 2011 in Corresponding Japanese Application No. 2004-069423.

* cited by examiner

POLISHING PAD AND METHOD OF PRODUCING SEMICONDUCTOR DEVICE

This application is the U.S. National Phase under 35 U.S.C. §371 of International Application PCT/JP2003/.015128, filed Nov. 27, 2003, which claims priority to Japanese Patent Application No. 2002-343199, filed Nov. 27, 2002, No. 2003-000331, filed Jan. 6, 2003, No. 2003-029477, filed Feb. 6, 2003, and No. 2003-064653, filed Mar. 11, 2003. The International Application was not published under PCT Article 21(2) in English.

TECHNICAL FIELD

The present invention relates to a polishing pad used in planarizing an uneven surface of a wafer by chemical mechanical polishing (CMP) and in particular to a polishing pad having a window for sensing a polished state etc. by an optical means, as well as a method of producing a semiconductor device by the polishing pad.

BACKGROUND ART

Production of a semiconductor device involves a step of forming an electroconductive film on the surface of a wafer to form a wiring layer by photolithography, etching etc., a step of forming an interlaminar insulating film on the wiring layer, etc., and an uneven surface made of an electroconductive material such as metal and an insulating material is generated on the surface of a wafer by these steps. In recent years, processing for fine wiring and multilayer wiring is advancing for the purpose of higher integration of semiconductor integrated circuits, and accordingly techniques of planarizing an uneven surface of a wafer have become important.

As the method of planarizing an uneven surface of a wafer, a CMP method is generally used. CMP is a technique wherein while the surface of a wafer to be polished is pressed against a polishing surface of a polishing pad, the surface of the wafer is polished with an abrasive in the form of slurry having abrasive grains dispersed therein (hereinafter, referred to as slurry).

As shown in FIG. 1, a polishing apparatus used generally in CMP is provided for example with a polishing platen 2 for supporting a polishing pad 1, a supporting stand (polishing head) 5 for supporting a polished material (wafer) 4, a backing material for uniformly pressurizing a wafer, and a mechanism of feeding an abrasive. The polishing pad 1 is fitted with the polishing platen 2 for example via a double-coated tape. The polishing platen 2 and the supporting stand 5 are provided with rotating shafts 6 and 7 respectively and are arranged such that the polishing pad 1 and the polished material 4, both of which are supported by them, are opposed to each other. The supporting stand 5 is provided with a pressurizing mechanism for pushing the polished material 4 against the polishing pad 1.

When such CMP is conducted, there is a problem of judging the planarity of wafer surface. That is, the point in time when desired surface properties or planar state are reached should be detected. With respect to the thickness of an oxide film, polishing speed etc., the polishing treatment of a test wafer has been conducted by periodically treating the wafer, and after the results are confirmed, a wafer serving as a product is subjected to polishing treatment.

In this method, however, the treatment time of a test wafer and the cost for the treatment are wasteful, and a test wafer and a product wafer not subjected to processing are different in polishing results due to a loading effect unique to CMP, and accurate prediction of processing results is difficult without actual processing of the product wafer.

Accordingly, there is need in recent years for a method capable of in situ detection of the point in time when desired surface properties and thickness are attained at the time of CMP processing, in order to solve the problem described above. In such detection, various methods are used. The detection means proposed at present include:

(1) a method of detecting torque wherein the coefficient of friction between a wafer and a pad is detected as a change of the rotational torque of a wafer-keeping head and a platen (U.S. Pat. No. 5,069,002), (2) an electrostatic capacity method of detecting the thickness of an insulating film remaining on a wafer (U.S. Pat. No. 5,081,421), (3) an optical method wherein a film thickness monitoring mechanism by a laser light is integrated in a rotating platen (JP-A 9-7985 and JP-A 9-36072), (4) a vibrational analysis method of analyzing a frequency spectrum obtained from a vibration or acceleration sensor attached to a head or spindle, (5) a detection method by applying a built-in differential transformer in a head, (6) a method wherein the heat of friction between a wafer and a polishing pad and the heat of reaction between slurry and a material to be polished are measured by an infrared radiation thermometer (U.S. Pat. No. 5,196,353), (7) a method of measuring the thickness of a polished material by measuring the transmission time of supersonic waves (JP-A 55-106769 and JP-A 7-135190), and (8) a method of measuring the sheet resistance of a metallic film on the surface of a wafer (U.S. Pat. No. 5,559,428). At present, the method (1) is often used, but the method (3) comes to be used mainly from the viewpoint of measurement accuracy and spatial resolution in non-constant measurement.

The optical detection means as the method (3) is specifically a method of detecting the endpoint of polishing by irradiating a wafer via a polishing pad through a window (light-transmitting region) with a light beam, and monitoring an interference signal generated by reflection of the light beam (FIG. 12).

At present, a He—Ne laser light having a wavelength light in the vicinity of 600 nm and a white light using a halogen lamp having a wavelength light in 380 to 800 nm is generally used.

In such method, the endpoint is determined by knowing an approximate depth of surface unevenness by monitoring a change in the thickness of a surface layer of a wafer. When such change in thickness becomes equal to the thickness of unevenness, the CMP process is finished. As a method of detecting the endpoint of polishing by such optical means and a polishing pad used in the method, various methods and polishing pads have been proposed.

A polishing pad having, as least a part thereof, a solid and uniform transparent polymer sheet passing a light of wavelengths of 190 to 3500 nm therethrough is disclosed (Japanese Patent Application National Publication (Laid-Open) No. 11-512977). Further, a polishing pad having a stepped transparent plug inserted into it is disclosed (JP-A 9-7985). A polishing pad having a transparent plug on the same surface as a polishing surface is disclosed (JP-A 10-83977). Further, a polishing pad wherein a light-permeable member comprises a water-insoluble matrix material and water-soluble particles dispersed in the water-insoluble matrix material and the light transmittance thereof at 400 to 800 nm is 0.1% or more is disclosed (JP-A 2002-324769 and JP-A 2002-324770). It is disclosed that a window for endpoint detection is used in any of the polishing pad.

As described above, a He—Ne laser light and a white light using a halogen lamp are used as the light beam, and when the white light is used, there is an advantage that the light of various wavelengths can be applied onto a wafer, and many profiles of the surface of the wafer can be obtained. When this white light is used as the light beam, detection accuracy should be increased in a broad wavelength range. In high integration and micronization in production of semiconductors in the future, the wiring width of an integrated circuit is expected to be further decreased, for which highly accurate optical endpoint detection is necessary, but the conventional window for endpoint detection does not have sufficiently satisfactory accuracy in a broad wavelength range.

The object of a first invention is to provide a polishing pad enabling highly accurate optical detection of endpoint during polishing and thus having excellent polishing characteristics (surface uniformity etc.) and a method of producing a semiconductor device by using the polishing pad.

An object of a second invention is to provide a polishing pad enabling highly accurate optical detection of endpoint during polishing and particularly preferably usable in a polishing apparatus using a He—Ne laser light or a semiconductor laser having a transmission wavelength in the vicinity of 600 to 700 nm and thus having excellent polishing characteristics (surface uniformity etc.). Another object of the second invention is to provide a polishing pad which can be easily and inexpensively produced, as well as a method of producing a semiconductor device by using the polishing pad.

On one hand, the window (light-transmitting region) described in the patent specifications supra is long in the circumferential direction of the polishing pad or is circular, as shown in FIGS. 2 and 3. In the case of the window having the shape described above, however, the window contacts intensively with only a part of a wafer during polishing the wafer, and thus there is a problem that uneven polishing occurs between a portion contacting with the window and a portion not contacting with the window. There is also a problem that an obtainable polishing profile is that of a limited portion contacting with the window.

The object of a third invention is to provide a polishing pad enabling highly accurate optical detection of endpoint during polishing, thus having excellent polishing characteristics (particularly in-plane uniformity etc.) and capable of giving the polishing profile of a wide area of a wafer, as well as a method of producing a semiconductor device by using the polishing pad.

DISCLOSURE OF THE INVENTION

The present inventors made extensive study in view of the circumstances described above, and as a result, they found that a light-transmitting region having a specific transmittance can be used as a light-transmitting region for a polishing pad, to solve the problem described above.

That is, a first invention relates to a polishing pad used in chemical mechanical polishing and having a polishing region and a light-transmitting region, wherein the light transmittance of the light-transmitting region over the wavelength range of 400 to 700 nm is 50% or more.

The rate of change of the light transmittance of the light-transmitting region at a wavelength of 400 to 700 nm represented by the following equation is preferably 50% or less:

$$\text{The rate of change (\%)} = \{(\text{maximum transmittance at 400 to 700 nm} - \text{minimum transmittance at 400 to 700 nm}) / \text{maximum transmittance at 400 to 700 nm}\} \times 100$$

Generally, as the decay of the intensity of light passing through the light-transmitting region of a polishing pad is decreased, the accuracy of detection of polishing endpoint and the accuracy of measurement of film thickness can be improved. Accordingly, the degree of light transmittance at the wavelength of the measurement light used is important for determination of the accuracy of detection of polishing endpoint and the accuracy of measurement of film thickness.

The first invention can maintain high detection accuracy in a wide wavelength range with less decay in light transmittance in the short-wavelength side.

In the polishing pad of the first invention, the light transmittance of the light-transmitting region over the wavelength range of 400 to 700 nm is 50% or more, preferably 70% or more. When the transmittance is lower than 50%, the decay of the intensity of light passing through the light-transmitting region is made significant due to the influence of a slurry layer during polishing and the influence of dressing trace, thus reducing the accuracy of detection of polishing endpoint and the accuracy of measurement of film thickness.

The rate of change of the transmittance of the light-transmitting region at a wavelength of 400 to 700 nm represented by the above equation is more preferably 30% or less. When the rate of change of the transmittance is higher than 50%, the decay of the intensity of light passing through the light-transmitting region is increased in the short-wavelength side, and the amplitude of interference light is decreased, thus the accuracy of detection of polishing endpoint and the accuracy of measurement of film thickness tend to be reduced.

The light transmittance of the light-transmitting region at a wavelength of 400 nm is preferably 70% or more. When the transmittance at a wavelength of 400 nm is higher than 70%, the accuracy of detection of polishing endpoint and the accuracy of measurement of film thickness can further be improved.

The light transmittance of the light-transmitting region over the wavelength range of 500 to 700 nm is preferably 90% or more, more preferably 95% or more. When the transmittance is 90% or more, the accuracy of detection of polishing endpoint and the accuracy of measurement of film thickness can be extremely improved.

The difference among the respective light transmittances of the light-transmitting region over the wavelength range of 500 to 700 nm is 5% or less, preferably 3% or less. When the difference among the light transmittances at the respective wavelengths is 5% or less, a wafer can be irradiated with constant incident light in spectrometrically analyzing the film thickness of the wafer, thus enabling calculation of accurate reflectance to improve detection accuracy.

A second invention relates to a polishing pad used in chemical mechanical polishing and having a polishing region and a light-transmitting region, wherein the thickness of the light-transmitting region is 0.5 to 4 mm, and the light transmittance of the light-transmitting region over the wavelength range of 600 to 700 nm is 80% or more.

A generally used polishing apparatus makes use of a laser having a detection light having an emission wavelength in the vicinity of 600 to 700 nm as described above, so that when the light transmittance in this wavelength region is 80% or more, high reflected light can be obtained to improve the accuracy of detection of film thickness. When the light transmittance is lower than 80%, reflected light is decreased, thus reducing the accuracy of detection of film thickness.

In the second invention, the light transmittance of the light-transmitting region over the wavelength range of 600 to 700 nm is preferably 90% or more.

The light transmittance of the light-transmitting region in the first and second inventions is the light transmittance of the light-transmitting region having a thickness of 1 mm or a thickness reduced to 1 mm. Generally, the light transmittance is changed depending on the thickness of the light-transmitting region, according to the Lambert-Beer law. Because the light transmittance is decreased as the thickness is increased, the light transmittance with the thickness fixed is calculated.

A third invention relates to a polishing pad used in chemical mechanical polishing and having a polishing region and a light-transmitting region, wherein the light-transmitting region is arranged between the central portion and the peripheral portion of the polishing pad, and the length (D) of the light-transmitting region in the diametrical direction is 3 times or more longer than the length (L) in the circumferential direction.

As described above, the length (D) of the light-transmitting region in the diametrical direction is 3 times or more longer than the length (L) in the circumferential direction, by which the light-transmitting region contacts uniformly with the whole surface of a wafer during polishing without contacting with only a certain part of the wafer, and thus the wafer can be uniformly polished to improve polishing characteristics. In polishing, a laser interference meter is transferred suitably in the diametrical direction within a range having the light-transmitting region, whereby the polishing profile of a large area of the wafer can be obtained, and thus the endpoint of the polishing process can be accurately and easily judged.

As used herein, the length (D) in the diametrical direction refers to the length of a portion where a straight line, passing through the center of gravity of the light-transmitting region and connecting the center of the polishing pad to the peripheral portion of the polishing pad, overlaps with the light-transmitting region. The length (L) in the circumferential direction refers to the length a portion where a straight line, passing through the center of gravity of the light-transmitting region and being perpendicular to a straight line connecting the center of the polishing pad to the peripheral region of the polishing pad, overlaps at the maximum degree with the light-transmitting region.

In the third invention, the light-transmitting region is arranged between the central portion and the peripheral portion of the polishing pad. Generally, the diameter of a wafer is smaller than the radius of a polishing pad, so that when the light-transmitting region is arranged between the central portion and the peripheral portion of the polishing pad, a polishing profile of a large area of the wafer can be sufficiently obtained. While when the length of the light-transmitting region is grater than, or equal to, the radius of the polishing pad, it is unfavorable that the polishing region is decreased and the efficiency of polishing is reduced.

When the length (D) of the light-transmitting region in the diametrical direction is not 3 times longer than the length (L) in the circumferential direction in the third invention, the length in the diametrical direction is not sufficient, and the portion of a wafer which can be irradiated with a light beam is limited to a predetermined range, and thus the detection of the film thickness of the wafer is insufficient, while when the length in the diametrical direction is made sufficiently long, the length (L) in the circumferential direction is also made long so that the polishing region is decreased and the efficiency of polishing tends to be lowering.

In the third invention, the shape of the light-transmitting region is preferably rectangular from the viewpoint of easier production.

In the third invention, the length (D) of the light-transmitting region in the diametrical direction is preferably ¼ to ½ relative to the diameter of a material to be polished. When the length (D) is less than ¼, the portion of a material to be polished (wafer etc.) which can be irradiated with a light beam is limited to a predetermined range, and thus the detection of the film thickness of the wafer is insufficient, and polishing tends to be uneven. On the other hand, when the length (D) is greater than ½, the polishing region is decreased, and thus the efficiency of polishing tends to be lowered. At least one light-transmitting region may be present in the polishing pad, but two or more light-transmitting regions may be arranged.

Further, the scatter of the thickness of the light-transmitting region is preferably 100 μm or less.

In the first to third inventions, materials for forming the polishing region and the light-transmitting region are preferably polyurethane resin. Preferably, the polyurethane resin as a material for forming the polishing region, and the polyurethane resin as a material for forming the light-transmitting region, comprise the same kinds of organic isocyanate, polyol and chain extender. By constituting the polishing region and the light-transmitting region from the same kinds of materials, the polishing region and the light-transmitting region, upon dressing treatment of the polishing pad, can be dressed to the same degree thereby achieving high planarity in the whole surface of the polishing pad. On the other hand, when they are not formed from the same kinds of materials, they are dressed in a different degree to deteriorate the planarity of the polishing pad. In this case, the hardness and dressing of the polishing region and the light-transmitting region are preferably regulated in the same degree.

In the first to third inventions, the material for forming the light-transmitting region is preferably non-foam. When the material is non-foam, light scattering can be suppressed so that accurate reflectance can be detected to improve the accuracy of optical detection of the endpoint of polishing.

It is preferable that the surface of the light-transmitting region at the polishing side does not have an uneven structure retaining and renewing an abrasive liquid. When macroscopic surface unevenness is present on the surface of the light-transmitting region at the polishing side, slurry containing additives such as abrasive grains is retained in its concave portion to cause light scattering and absorption to exert influence on detection accuracy. Preferably, the other surface of the light-transmitting region does not have macroscopic surface unevenness either. This is because when macroscopic surface unevenness is present, light scattering easily occurs, which may exert influence on detection accuracy.

In the first to third inventions, the material for forming the polishing region is fine-cell foam.

In the first to third inventions, the surface of the polishing region at the polishing side is provided with grooves.

Also, the average cell diameter of the fine-cell foam is preferably 70 μm or less, more preferably 50 μm or less. When the average cell diameter is 70 μm or less, planarity is improved.

The specific gravity of the fine-cell foam is preferably 0.5 to 1.0 g/cm$^3$, more preferably 0.7 to 0.9 g/cm$^3$. When the specific gravity is less than 0.5 g/cm$^3$, the strength of the surface of the polishing region is lowered to reduce the planarity of an object of polishing, while when the specific gravity is higher than 1.0 g/cm$^3$, the number of fine cells on the surface of the polishing region is decreased, and planarity is good, but the rate of polishing tends to be decreased.

The hardness of the fine-cell foam is preferably 45 to 65°, more preferably 45 to 60°, in terms of Asker D hardness. When the Asker D hardness is less than 45°, the planarity of an object of polishing is decreased, while when the planarity is greater than 65°, the planarity is good, but the uniformity of an object of polishing tends to be decreased.

The compressibility of the fine-cell foam is preferably 0.5 to 5.0%, more preferably 0.5 to 3.0%. When the compressibility is in this range, both planarity and uniformity can be satisfied. The compressibility is a value calculated from the following equation:

$$\text{Compressibility (\%)}=\{(T1-T2)/T1\}\times 100$$

T1: the thickness of fine-cell foam after the fine-cell foam in a non-loaded state is loaded with a stress of 30 KPa (300 g/cm$^2$) for 60 seconds.

T2: the thickness of the fine-cell foam after the fine-cell foam allowed to be in the T1 state is loaded with a stress of 180 KPa (1800 g/cm$^2$) for 60 seconds.

The compression recovery of the fine-cell foam is preferably 50 to 100%, more preferably 60 to 100%. When the compression recovery is less than 50%, the thickness of the polishing region is significantly changed as loading during polishing is repeatedly applied onto the polishing region, and the stability of polishing characteristics tends to be lowered. The compression recovery is a value calculated from the following equation:

$$\text{Compression recovery (\%)}=[(T3-T2)/(T1-T2)]\times 100$$

T1: the thickness of fine-cell foam after the fine-cell foam in a non-loaded state is loaded with a stress of 30 KPa (300 g/cm$^2$) for 60 seconds.

T2: the thickness of the fine-cell foam after the fine-cell foam after allowed to be in the T1 state is loaded with a stress of 180 KPa (1800 g/cm$^2$) for 60 seconds.

T3: the thickness of the fine-cell foam after the fine-cell foam after allowed to be in the T2 state is kept without loading for 60 seconds and then loaded with a stress of 30 KPa (300 g/cm$^2$) for 60 seconds.

The storage elastic modulus of the fine-cell foam at 40° C. at 1 Hz is preferably 200 MPa or more, more preferably 250 MPa or more. When the storage elastic modulus is less than 200 MPa, the strength of the surface of the polishing region is lowered and the planarity of an object of polishing tends to be reduced. The storage elastic modulus refers to the elastic modulus determined by measuring the fine-cell foam by applying sinusoidal wave vibration with a tensile testing jig in a dynamic viscoelastometer.

The first to third inventions relate to a method of producing a semiconductor device, which comprises a step of polishing the surface of a semiconductor wafer with the polishing pad described above.

BEST MODE FOR CARRYING OUT THE INVENTION

Figure 1:
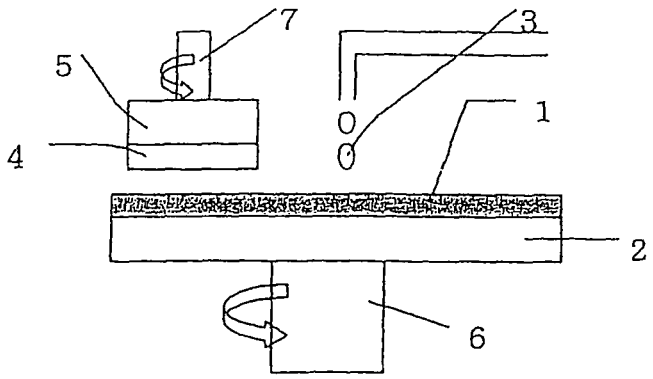
FIG. 1 is a schematic illustration showing one example of a conventional polishing apparatus used in CMP polishing.
Figure 2:
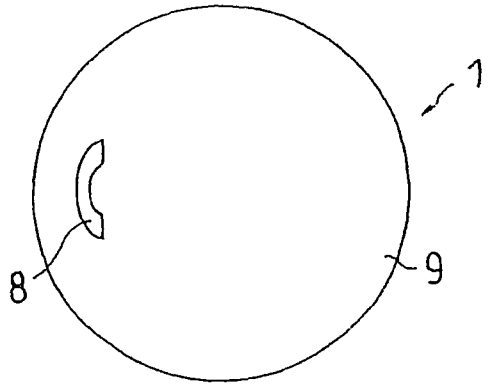
FIG. 2 is a schematic view showing one example of a polishing pad having a conventional light-transmitting region.

The polishing pad in the first to third inventions has a polishing region and a light-transmitting region.

The material for forming the light-transmitting region in the polishing pad of the first invention is not particularly limited insofar as the light transmittance over the wavelength range of 400 to 700 nm is 50% or more.

The material for forming the light-transmitting region in the polishing pad of the second invention is not particularly limited insofar as the light transmittance over the wavelength range of 600 to 700 nm is 80% or more.

The material for forming the light-transmitting region in the polishing pad of the third invention is not particularly limited, but is preferably the one having a light transmittance of 10% or more in the measurement wavelength range (generally 400 to 700 nm). When the light transmittance is less than 10%, reflected light is decreased due to the influence of slurry fed during polishing and dressing trace, thus reducing the accuracy of detection of film thickness or making detection infeasible.

The material for forming the light-transmitting region includes, for example, polyurethane resin, polyester resin, polyamide resin, acrylic resin, polycarbonate resin, halogenated resin (polyvinyl chloride, polytetrafluoroethylene, polyvinylidene fluoride etc.), polystyrene, olefinic resin (polyethylene, polypropylene etc.), epoxy resin and photosensitive resin. These may be used alone or as a mixture of two or more thereof. It is preferable to use the forming material used in the polishing region and a material having physical properties similar to those of the polishing region. Particularly, polyurethane resin having high abrasion resistance capable of suppressing the light scattering of the light-transmitting region due to dressing trace during polishing is desirable.

The polyurethane resin comprises an organic isocyanate, a polyol compound and a chain extender.

The organic isocyanate includes 2,4-toluene diisocyanate, 2,6-toluene diisocyanate, 2,2'-diphenylmethane diisocyanate, 2,4'-diphenylmethane diisocyanate, 4,4'-diphenylmethane diisocyanate, 1,5-naphthalene diisocyanate, p-phenylene diisocyanate, m-phenylene diisocyanate, p-xylylene diisocyanate, m-xylylene diisocyanate, hexamethylene diisocyanate 1,4-cyclohexan diisocyanate, 4,4'-dicyclohexylmethane diisocyanate, isophorone diisocyanate etc. These may be used alone or as a mixture of two or more thereof.

The usable organic isocyanate includes not only the isocyanate compounds described above but also multifunctional (trifunctional or more) polyisocyanate compounds. As the multifunctional isocyanate compounds, Desmodule-N (manufactured by Bayer Ltd.) and a series of diisocyanate adduct compounds under the trade name of Duranate (Asahi Kasei Corporation) are commercially available. Because the trifunctional or more polyisocyanate compound, when used singly in synthesizing a prepolymer, is easily gelled, the polyisocyanate compound is used preferably by adding it to the diisocyanate compound.

The polyol includes polyether polyols represented by polytetramethylene ether glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a multivalent alcohol and reacting the resulting reaction mixture with an organic dicarboxylic acid, and polycarbonate polyols obtained by ester exchange reaction of a polyhydroxyl compound with aryl carbonate. These may be used singly or as a mixture of two or more thereof.

The polyol includes not only the above polyols but also low-molecular-weight polyols such as ethylene glycol, 1,2-propylene glycol, 1,3-propylene glycol, 1,4-butane diol, 1,6-hexane diol, neopentyl glycol, 1,4-cyclohexane dimethanol, 3-methyl-1,5-pentane diol, diethylene glycol, triethylene glycol, 1,4-bis(2-hydroxyethoxy) benzene etc.

The chain extender includes low-molecular-weight polyols such as ethylene glycol, 1,2-propylene glycol, 1,3-propylene glycol, 1,4-butane diol, 1,6-hexane diol, neopentyl glycol, 1,4-cyclohexane dimethanol, 3-methyl-1,5-pentane diol, diethylene glycol, triethylene glycol, 1,4-bis(2-hydroethoxy) benzene etc., and polyamines such as 2,4-toluene diamine, 2,6-toluene diamine, 3,5-diethyl-2,4-toluene diamine, 4,4'-di-sec-butyl-diaminodiphenyl methane, 4,4'-diaminodiphenyl methane, 3,3'-dichloro-4,4'-diaminodiphenyl methane, 2,2',3,3'-tetrachloro-4,4'-diaminodiphenyl methane, 4,4'-diamino-3,3'-diethyl-5,5'-dimethyl diphenyl methane, 3,3'-diethyl-4,4'-diaminodiphenyl methane, 4,4'-methylene-bis-methyl anthranylate, 4,4'-methylene-bis-anthranylic acid, 4,4'-diaminodiphenyl sulfone, N,N'-di-sec-butyl-p-phenylene diamine, 4,4'-methylene-bis(3-chloro-2,6-diethylamine), 3,3'-dichloro-4,4'-diamino-5,5'-diethyl diphenyl methane, 1,2-bis(2-aminophenylthio) ethane, trimethylene glycol-di-p-aminobenzoate, 3,5-bis(methylthio)-2,4-toluene diamine etc. These may be used singly or as a mixture of two or more thereof. However, the polyamine is often colored by itself, and resin using the same is also colored, and thus the polyamine is blended preferably in such a range that the physical properties and light transmittance are not deteriorated. When the compound having an aromatic hydrocarbon group is used, the light transmittance in the short-wavelength side tends to be decreased, and thus such compound is preferably not used, but may be blended in such a range that the required transmittance is not deteriorated.

The proportion of the organic isocyanate, the polyol and the chain extender in the polyurethane resin can be changed suitably depending on their respective molecular weights, desired physical properties of the light-transmitting region produced therefrom, etc. To allow the light-transmitting region to achieve the above properties, the ratio of the number of isocyanate groups of the organic isocyanate to the number of functional groups in total (hydroxyl group+amino group) in the polyol and the chain extender is preferably 0.95 to 1.15, more preferably 0.99 to 1.10.

The polyurethane resin can be polymerized by known urethane-making techniques such as a melting method, a solution method etc., but in consideration of cost and working atmosphere, the polyurethane resin is formed preferably by the melting method.

The polyurethane resin can be produced by a prepolymer method or a one-shot method, but the prepolymer method wherein an isocyanate-terminated prepolymer synthesized previously from an organic isocyanate and a polyol is reacted with a chain extender is generally used. When a commercially available isocyanate-terminated prepolymer produced from an organic isocyanate and a polyol can be adapted to the present invention, the commercial product can be used in the prepolymer method, to polymerize the polyurethane used in the present invention.

The method of preparing the light-transmitting region is not particularly limited, and the light-transmitting region can be prepared according to methods known in the art. For example, a method wherein a block of polyurethane resin produced by the method described above is cut in a predetermined thickness by a slicer in a handsaw system or a planing system, a method that involves casting resin into a mold having a cavity of predetermined thickness and then curing the resin, a method of using coating techniques and sheet molding techniques, etc. are used. When there are bubbles in the light-transmitting region, the decay of reflected light becomes significant due to light scattering, thus reducing the accuracy of detection of polishing endpoint and the accuracy of measurement of film thickness. Accordingly, gas contained in the material before mixing is sufficiently removed under reduced pressure at 10 Torr or less. In the case of a usually used stirring blade mixer, the mixture is stirred at a revolution number of 100 rpm or less so as not to permit bubbles to be incorporated into it in the stirring step after mixing. The stirring step is also preferably conducted under reduced pressure. When a rotating mixer is used, bubbles are hardly mixed even in high rotation, and thus a method of stirring and defoaming by using this mixer is also preferable.

In the first and second inventions, the shape and size of the light-transmitting region are not particularly limited, but are preferably similar to the shape and size of the opening of the polishing region.

Figure 4:
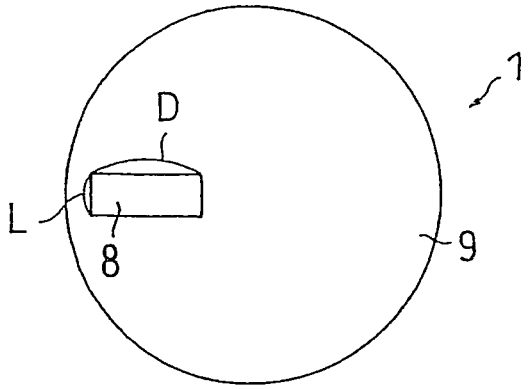
FIG. 4 is a schematic view showing one example of the polishing pad having a light-transmitting region in the third invention.
Figure 5:
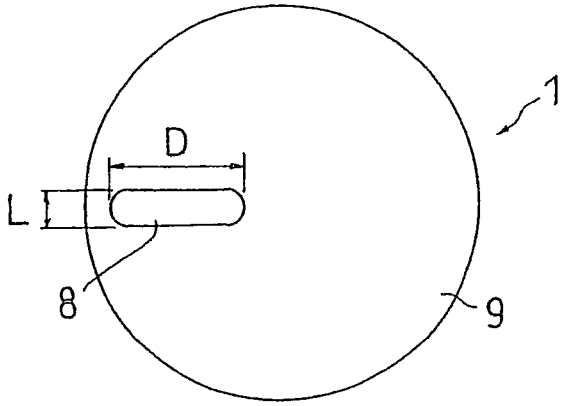
FIG. 5 is a schematic view showing another example of the polishing pad having a light-transmitting region in the third invention.
Figure 6:
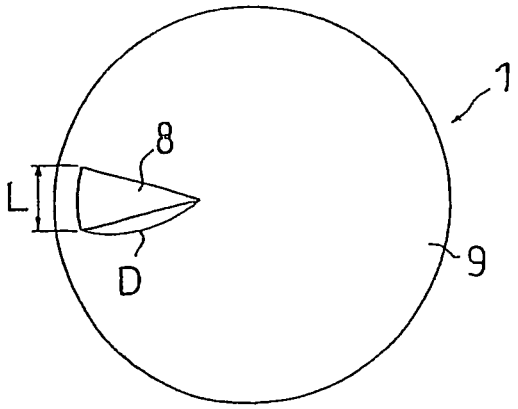
FIG. 6 is a schematic view showing another example of the polishing pad having a light-transmitting region in the third invention.

In the third invention, the light-transmitting region is not particularly limited insofar as the length (D) in the diametrical direction is 3 times or more longer than the length (L) of the polishing pad in the circumferential direction, and specifically the shapes shown in FIGS. 4 to 6 can be mentioned.

In the first and third inventions, the thickness of the light-transmitting region is not particularly limited, but is preferably equal to, or smaller than, the thickness of the polishing region. When the light-transmitting region is thicker than the polishing region, an object of polishing is damaged by its raised region during polishing, or an object of polishing (wafer) may be removed from a supporting stand (polishing head).

In the second invention, on the other hand, the thickness of the light-transmitting region is 0.5 to 4 mm, preferably 0.6 to 3.5 mm. This is because the thickness of the light-transmitting region is preferably equal to, or smaller than, the thickness of the polishing region. When the light-transmitting region is thicker than the polishing region, an object of polishing may be damaged by its raised region during polishing. On the other hand, when the light-transmitting region is too thin, durability is insufficient, and slurry Is easily retained thereon to reduce detection sensitivity.

In the first to third inventions, the scatter of the thickness of the light-transmitting region is preferably 100 μm or less, more preferably 50 μm or less, particularly preferably 30 μm or less. When the scatter of the thickness is higher than 100 μm, large undulation is caused to generate portions different in a contacting state with an object of polishing, thus influencing polishing characteristics (in-plane uniformity and planarizing property etc.). Particularly, when the light-transmitting region is non-foam while the polishing region is fine-cell foam, the hardness of the light-transmitting region is considerably higher than the hardness of the polishing region, and thus the influence of the scatter of the thickness of the light-transmitting region on polishing characteristics tends to be higher than that of the thickness of the polishing region.

The method of suppressing the scatter of thickness includes a method of buffing the surface of a sheet having a predetermined thickness. Buffing is conducted preferably stepwise by using polishing sheets different in grain size. When the light-transmitting region is subjected to buffing, the surface roughness is preferably lower. When the surface roughness is high, incident light is irregularly reflected on the surface of the light-transmitting region, thus reducing transmittance and reducing detection accuracy.

The material for forming the polishing region can be used without particular limitation insofar as it is usually used as the material of a polishing layer, but in the present invention, fine-cell foam is preferably used. When the fine-cell foam is used, slurry can be retained on cells of the surface to increase the rate of polishing.

The material for forming the polishing region includes, for example, polyurethane resin, polyester resin, polyamide resin, acrylic resin, polycarbonate resin, halogenated resin (polyvinyl chloride, polytetrafluoroethylene, polyvinylidene fluoride etc.), polystyrene, olefinic resin (polyethylene, polypropylene etc.), epoxy resin, and photosensitive resin. These may be used alone or as a mixture of two or more thereof. The material for forming the polishing region may have a composition identical with, or different from, that of the light-transmitting region, but is preferably the same material as that of the light-transmitting region.

The polyurethane resin is a particularly preferable material because it is excellent in abrasion resistance and serves as a polymer having desired physical properties by changing the composition of its starting materials.

The polyurethane resin comprises an organic isocyanate, a polyol and a chain extender.

The organic isocyanate used is not particularly limited, and for example, the organic isocyanate described above can be mentioned.

The polyol used is not particularly limited, and for example, the polyol described above can be mentioned. The number-average molecular weight of the polyol is not particularly limited, but is preferably about 500 to 2000, more preferably 500 to 1500, from the viewpoint of the elastic characteristics and the like of the resulting polyurethane. When the number-average molecular weight is less than 500, the polyurethane obtained therefrom does not have sufficient elastic characteristics, thus becoming a brittle polymer. Accordingly, a polishing pad produced from this polyurethane is rigid to cause scratch of the polished surface of an object of polishing. Further, because of easy abrasion, such polyurethane is not preferable from the viewpoint of the longevity of the pad. On the other hand, when the number-average molecular weight is higher than 2000, polyurethane obtained therefrom becomes soft, and thus a polishing pad produced from this polyurethane tends to be inferior in planarizing property.

The molecular-weight distribution (weight-average molecular weight/number-average molecular weight) of the polyol used is preferably less than 1.9, more preferably 1.7 or less. When a polyol having a molecular-weight distribution of 1.9 or more, the temperature dependence of the hardness (modulus of elasticity) of polyurethane obtained therefrom is increased, and a polishing pad produced from this polyurethane shows a great difference in hardness (modulus of elasticity) depending on temperature. Because frictional heat is generated between the polishing pad and an object of polishing, the temperature of the polishing pad during polishing is changed. Accordingly, the polishing characteristics are unfavorably changed. The molecular-weight distribution can be measured for example with a GPC unit by using standard PPG (polypropylene polyol).

As the polyol, not only the high-molecular polyols mentioned above, but also low-molecular polyols such as ethylene glycol, 1,2-propylene glycol, 1,3-propylene glycol, 1,4-butane diol, 1,6-hexane diol, neopentyl glycol, 1,4-cyclohexane dimethanol, 3-methyl-1,5-pentane diol, diethylene glycol, triethylene glycol, 1,4-bis(2-hydroxyethoxy) benzene. can be simultaneously used.

The ratio of the high-molecular component to the low-molecular component in the polyol is determined depending on characteristics required of the polishing region produced therefrom.

The chain extender includes polyamines such as 2,4-toluene diamine, 2,6-toluene diamine, 3,5-diethyl-2,4-toluene diamine, 4,4'-di-sec-butyl-diaminodiphenyl methane, 4,4'-diaminodiphenyl methane, 3,3'-dichloro-4,4'-diaminodiphenyl methane, 2,6-dichloro-p-phenylene diamine, 4,4'-methylene bis(2,3-dichloroaniline), 2,2',3,3'-tetrachloro-4,4'-diaminodiphenyl methane, 4,4'-diamino-3,3'-diethyl-5,5'-dimethyl diphenyl methane, 3,3'-diethyl-4,4'-diaminodiphenyl methane, 4,4'-methylene-bis-methyl anthranylate, 4,4'-methylene-bis-anthranylic acid, 4,4'-diaminodiphenyl sulfone, N,N'-di-sec-butyl-p-phenylene diamine, 4,4'-methylene-bis(3-chloro-2,6-diethylamine), 3,3'-dichloro-4,4'-diamino-5,5'-diethyl diphenyl methane, 1,2-bis(2-aminophenylthio) ethane, trimethylene glycol-di-p-aminobenzoate, 3,5-bis(methylthio)-2,4-toluene diamine etc., or the above-described low-molecular polyols. These may be used singly or as a mixture of two or more thereof.

The proportion of the organic isocyanate, the polyol and the chain extender in the polyurethane resin can be changed suitably depending on their respective molecular weights, desired physical properties of the polishing region produced therefrom, etc. To obtain the polishing region excellent in polishing characteristics, the ratio of the number of isocyanate groups of the organic isocyanate to the number of functional groups in total (hydroxyl group+amino group) in the polyol and the chain extender is preferably 0.95 to 1.15, more preferably 0.99 to 1.10.

The polyurethane resin can be produced by the same method as described above. A stabilizer such as an antioxidant etc., a surfactant, a lubricant, a pigment, a filler, an antistatic and other additives may be added if necessary to the polyurethane resin.

The method of finely foaming the polyurethane resin includes, but is not limited to, a method of adding hollow beads and a method of forming foam by mechanical foaming, chemical foaming etc. These methods can be simultaneously used, but the mechanical foaming method using an active hydrogen group-free silicone-based surfactant consisting of a polyalkyl siloxane/polyether copolymer is more preferable. As the silicone-based surfactant, SH-192 (Toray Dow Corning Silicone Co., Ltd.) can be mentioned as a preferable compound.

An example of the method of producing closed-cell polyurethane foam used in the polishing region is described below. The method of producing such polyurethane foam has the following steps.

(1) Stirring Step of Preparing a Cell Dispersion of an Isocyanate-Terminated Prepolymer A silicone-based surfactant is added to an isocyanate-terminated prepolymer and stirred in an inert gas, and the inert gas is dispersed as fine cells to form a cell dispersion. When the isocyanate-terminated prepolymer is in a solid form at ordinary temperatures, the prepolymer is used after melted by pre-heating to a suitable temperature.

(2) Step of Mixing a Curing Agent (Chain Extender)

A chain extender is added to, and mixed with, the cell dispersion under stirring.

(3) Curing Step

The isocyanate-terminated prepolymer mixed with the chain extender is cast in a mold and heat-cured.

The inert gas used for forming fine cells is preferably not combustible, and is specifically nitrogen, oxygen, a carbon dioxide gas, a rare gas such as helium and argon, and a mixed gas thereof, and the air dried to remove water is most preferable in respect of cost.

As a stirrer for dispersing the silicone-based surfactant-containing isocyanate-terminated prepolymer to form fine cells with the inert gas, known stirrers can be used without particular limitation, and examples thereof include a homogenizer, a dissolver, a twin-screw planetary mixer etc. The shape of a stirring blade of the stirrer is not particularly limited either, but a whipper-type stirring blade is preferably used to form fine cells.

In a preferable mode, different stirrers are used in stirring for forming a cell dispersion in the stirring step and in stirring for mixing an added chain extender in the mixing step, respectively. In particular, stirring in the mixing step may not be stirring for forming cells, and a stirrer not generating large cells is preferably used. Such a stirrer is preferably a planetary mixer. The same stirrer may be used in the stirring step and the mixing step, and stirring conditions such as revolution rate of the stirring blade are preferably regulated as necessary.

In the method of producing the polyurethane foam with fine cells, heating and post-curing of the foam obtained after casting and reacting the cell dispersion in a mold until the dispersion lost fluidity are effective in improving the physical properties of the foam, and are extremely preferable. The cell dispersion may be cast in a mold and immediately post-cured in a heating oven, and even under such conditions, heat is not immediately conducted to the reactive components, and thus the diameters of cells are not increased. The curing reaction is conducted preferably at normal pressures to stabilize the shape of cells.

In the production of the polyurethane resin, a known catalyst promoting polyurethane reaction, such as tertiary amine- or organotin-based catalysts, may be used. The type and amount of the catalyst added are determined in consideration of flow time in casting in a predetermined mold after the mixing step.

Production of the polyurethane foam may be in a batch system where each component is weighed out, introduced into a vessel and mixed or in a continuous production system where each component and an inert gas are continuously supplied to, and stirred in, a stirring apparatus and the resulting cell dispersion is transfered to produce molded articles.

The polishing region serving as a polishing layer is produced by cutting the above prepared polyurethane foam into a piece of predetermined size.

In the first to third inventions, the polishing region consisting of fine-cell foam is preferably provided with grooves for retaining and renewing slurry on the surface of the polishing pad which contacts with an object of polishing. The polishing region composed of fine-cell foam has many openings to retain slurry, and for further efficient retention and renewal of slurry and for preventing the destruction of an object of polishing by adsorption, the polishing region preferably has grooves on the surface thereof in the polishing side. The shape of the grooves is not particularly limited insofar as slurry can be retained and renewed, and examples include latticed grooves, concentric circle-shaped grooves, through-holes, non-through-holes, polygonal prism, cylinder, spiral grooves, eccentric grooves, radial grooves, and a combination of these grooves. The groove pitch, groove width, groove thickness etc. are not particularly limited either, and are suitably determined to form grooves. These grooves are generally those having regularity, but the groove pitch, groove width, groove depth etc. can also be changed at each certain region to make retention and renewal of slurry desirable.

The method of forming grooves is not particularly limited, and for example, formation of grooves by mechanical cutting with a jig such as a bite of predetermined size, formation by casting and curing resin in a mold having a specific surface shape, formation by pressing resin with a pressing plate having a specific surface shape, formation by photolithography, formation by a printing means, and formation by a laser light using a $CO_2$ gas laser or the like.

Although the thickness of the polishing region is not particularly limited, the thickness is about 0.8 to 2.0 mm. The method of preparing the polishing region of this thickness includes a method wherein a block of the fine-cell foam is cut in predetermined thickness by a slicer in a bandsaw system or a planing system, a method that involves casting resin into a mold having a cavity of predetermined thickness and curing the resin, a method of using coating techniques and sheet molding techniques, etc.

The scatter of the thickness of the polishing region is preferably 100 μm or less, more preferably 50 μm or less. When the scatter of the thickness is higher than 100 μm, large undulation is caused to generate portions different in a contacting state with an object of polishing, thus adversely influencing polishing characteristics. To solve the scatter of the thickness of the polishing region, the surface of the polishing region is dressed generally in an initial stage of polishing by a dresser having abrasive grains of diamond deposited or fused thereon, but the polishing region outside of the range described above requires a longer dressing time to reduce the efficiency of production. As a method of suppressing the scatter of thickness, there is also a method of buffing the surface of the polishing region having a predetermined thickness. Buffing is conducted preferably stepwise by using polishing sheets different in grain size.

The method of preparing a polishing pad having the polishing region and the light-transmitting region is not particularly limited, and various methods are conceivable, and specific examples are described below. In the following specific examples, a polishing pad provided with a cushion layer is described, but the cushion layer may not be arranged in the polishing pad.

Figure 7:
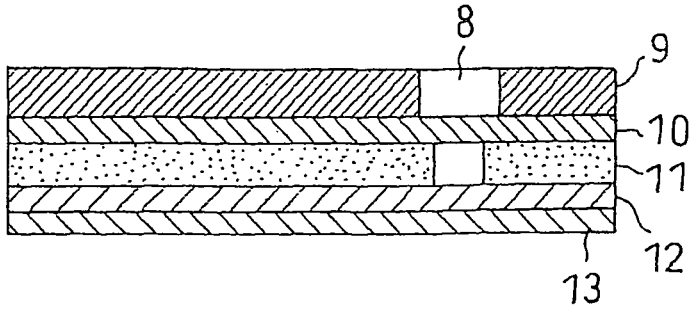
FIG. 7 is a schematic sectional view showing one example of the polishing pad of the present invention.

In a first example, as shown in FIG. 7, a polishing region 9 having an opening of specific size is stuck on a double-coated tape 10, and then a cushion layer 11 having an opening of specific size is stuck thereon such that its opening is in the same position as the opening of the polishing region 9. Then, a double-coated tape 12 provided with a release paper 13 is stuck on the cushion layer 11, and a light-transmitting region 8 is inserted into, and stuck on, the opening of the polishing region 9.

Figure 8:
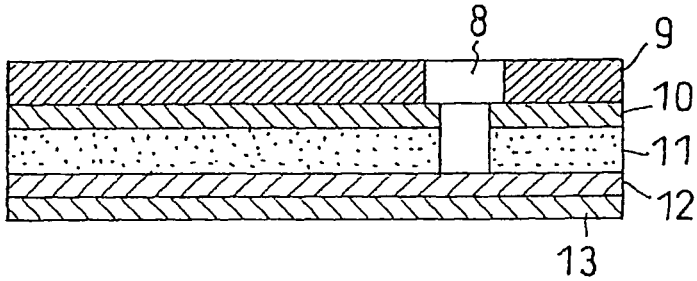
FIG. 8 is a schematic sectional view showing another example of the polishing pad of the present invention.

In a second example, as shown in FIG. 8, a polishing region 9 having an opening of specific size is stuck on a double-coated tape 10, and then a cushion layer 11 is stuck thereon. Thereafter, the double-coated tape 10 and the cushion layer 11 are provided with an opening of specific size so as to be fitted to the opening of the polishing region 9. Then, a double-coated tape 12 provided with a release paper 13 is stuck on the cushion layer 11, and a light-transmitting region 8 is inserted into, and stuck on, the opening of the polishing region 9.

Figure 9:
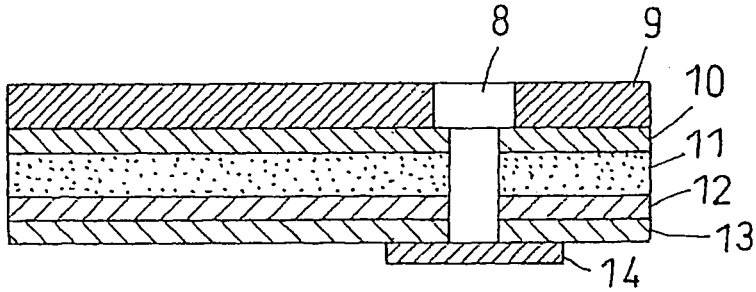
FIG. 9 is a schematic sectional view showing another example of the polishing pad of the present invention.

In a third example, as shown in FIG. 9, a polishing region 9 having an opening of specific size is stuck on a double-coated tape 10, and then a cushion layer 11 is stuck thereon. Then, a double-coated tape 12 provided with a release paper 13 is stuck on the other side of the cushion layer 11, and thereafter, an opening of predetermined size to be fitted to the opening of the polishing region 9 is produced from the double-coated tape 10 to the release paper 13. A light-transmitting region 8 is inserted into, and stuck on, the opening of the polishing region 9. In this case, the opposite side of the light-transmitting region 8 is open so that dust etc. may be accumulated, and thus a member 14 for closing it is preferably attached.

Figure 10:
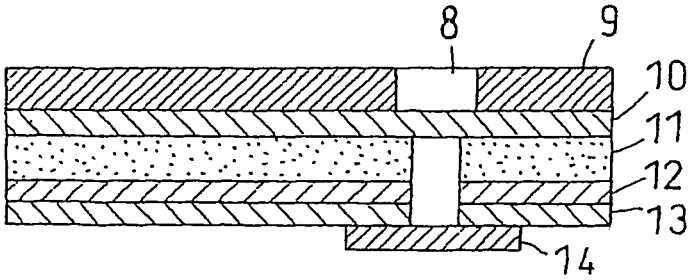
FIG. 10 is a schematic sectional view showing another example of the polishing pad of the present invention.

In a fourth example, as shown in FIG. 10, a cushion layer 11 having a double-coated tape 12 provided with a release paper 13 is provided with an opening of predetermined size. Then, a polishing region 9 having an opening of predetermined size is stuck on a double-coated tape 10 which is then stuck on the cushion layer 11 such that their openings are positioned in the same place. Then, a light-transmitting region 8 is inserted into, and stuck on, the opening of the polishing region 9. In this case, the opposite side of the polishing region is open so that dust etc. may be accumulated, and thus a member 14 for closing it is preferably attached.

In the method of preparing the polishing pad, the means of forming an opening in the polishing region and the cushion layer is not particularly limited, but for example, a method of opening by pressing with a jig having a cutting ability, a method of utilizing a laser such as a $CO_2$ laser, and a method of cutting with a jig such as a bite. The size and shape of the opening of the polishing region in the first and second inventions are not particularly limited.

The cushion layer compensates for characteristics of the polishing region (polishing layer). The cushion layer is required for satisfying both planarity and uniformity which are in a tradeoff relationship in chemical mechanical polishing (CMP). Planarity refers to flatness of a pattern region upon polishing an object of polishing having fine unevenness generated upon pattern formation, and uniformity refers to the uniformity of the whole of an object of polishing. Planarity is improved by the characteristics of the polishing layer, while uniformity is improved by the characteristics of the cushion layer. The cushion layer used in the polishing pad of the present invention is preferably softer than the polishing layer.

The material forming the cushion layer is not particularly limited, and examples of such material include a nonwoven fabric such as a polyester nonwoven fabric, a nylon nonwoven fabric or an acrylic nonwoven fabric, a nonwoven fabric impregnated with resin such as a polyester nonwoven fabric impregnated with polyurethane, polymer resin foam such as polyurethane foam and polyethylene foam, rubber resin such as butadiene rubber and isoprene rubber, and photosensitive resin.

The means of sticking the polishing layer used in the polishing region 9 on the cushion layer 11 includes, for example, a method of pressing the polishing region and the cushion layer having a double-coated tape therebetween.

The double-coated tape has a general constitution wherein an adhesive layer is arranged on both sides of a base material such as a nonwoven fabric or a film. In consideration of permeation of slurry into the cushion layer, a film is preferably used as the base material. The composition of the adhesive layer includes, for example, a rubber-based adhesive and an acrylic adhesive. In consideration of the content of metallic ion, the acrylic adhesive is preferable because of a lower content of metallic ion. Because the polishing region and the cushion layer can be different in composition, the composition of each adhesive layer of the double-coated tape can be different to make the adhesion of each layer suitable.

The means of sticking the cushion layer 11 on the double-coated tape 12 includes a method of sticking the double-coated tape by pressing on the cushion layer.

As described above, the double-coated tape has a general constitution wherein an adhesive layer is arranged on both sides of a base material such as a nonwoven fabric or a film. In consideration of removal of the polishing pad after use from a platen, a film is preferably used as the base material in order to solve a residual tape. The composition of the adhesive layer is the same as described above.

The member 14 is not particularly limited insofar as the opening is closed therewith. When polishing is conducted, it should be releasable.

The semiconductor device is produced by a step of polishing the surface of a semiconductor wafer by using the polishing pad. The semiconductor wafer generally comprises a wiring metal and an oxide film laminated on a silicon wafer. The method of polishing a semiconductor wafer and a polishing apparatus are not particularly limited, and as shown in FIG. 1, polishing is conducted for example by using a polishing apparatus including a polishing platen 2 for supporting a polishing pad 1, a supporting stand (polishing head) 5 for supporting a semiconductor wafer 4, a backing material for uniformly pressurizing the wafer, and a mechanism of feeding an abrasive 3. The polishing pad 1 is fitted, for example via a double-coated tape, with the polishing platen 2. The polishing platen 2 and the supporting stand 5 are provided with rotating shafts 6 and 7 and arranged such that the polishing pad 1 and the semiconductor wafer 4, both of which are supported by them, are arranged to be opposite to each other. The supporting stand 5 is provided with a pressurizing mechanism for pushing the semiconductor wafer 4 against the polishing pad 1. For polishing, the polishing platen 2 and the supporting stand 5 are rotated and simultaneously the semiconductor wafer 4 is polished by pushing it against the polishing pad 1 with slurry fed thereto. The flow rate of slurry, polishing loading, number of revolutions of the polishing platen, and number of revolutions of the wafer are not particularly limited and can be suitably regulated.

Protrusions on the surface of the semiconductor wafer 4 are thereby removed and polished flatly. Thereafter, a semiconductor device is produced therefrom through dicing, bonding, packaging etc. The semiconductor device is used in an arithmetic processor, a memory etc.

EXAMPLES

Hereinafter, the Examples illustrating the constitution and effect of the first to third inventions are described. Evaluation items in the Examples etc. were measured in the following manner.

(Measurement of Light Transmittance in the First Invention)

The prepared light-transmitting region member was cut out with a size of 2 cm×6 cm (thickness: arbitrary) to prepare a sample for measurement of light transmittance. Using a spectrophotometer (U-3210 Spectro Photometer, manufactured by Hitachi, Ltd.), the sample was measured in the range of measurement wavelengths of 300 to 700 nm. In the measurement result of light transmittance, transmittance per mm thickness was expressed by using the Lambert-Beer law.

(Measurement of Light Transmittance in the Second Invention)

The prepared light-transmitting region member was cut out with a size of 2 cm×6 cm (thickness: 1.25 mm) to prepare a sample for measurement of transmittance. Using a spectrophotometer (U-3210 Spectro Photometer, manufactured by Hitachi, Ltd.), the sample was measured in the range of measurement wavelengths of 600 to 700 nm. In the measurement result of light transmittance, light transmittance per mm thickness was expressed by using the Lambert-Beer law.

(Measurement of Average Cell Diameter)

A polishing region cut parallel to be as thin as about 1 mm by a microtome cutter was used as a sample for measurement of average cell diameter. The sample was fixed on a slide glass, and the diameters of all cells in an arbitrary region of 0.2 mm×0.2 mm were determined by an image processor (Image Analyzer V10, manufactured by Toyobouseki Co., Ltd), to calculate the average cell diameter.

(Measurement of Specific Gravity)

Determined according to JIS Z8807-1976. A polishing region cut out in the form of a strip of 4 cm×8.5 cm (thickness: arbitrary) was used as a sample for measurement of specific gravity and left for 16 hours in an environment of a temperature of 23±2° C. and a humidity of 50%±5%. Measurement was conducted by using a specific gravity hydrometer (manufactured by Sartorius Co., Ltd).

(Measurement of Asker D Hardness)

Measurement is conducted according to JIS K6253-1997. A polishing region cut out in a size of 2 cm×2 cm (thickness: arbitrary) was used as a sample for measurement of hardness and left for 16 hours in an environment of a temperature of 23±2° C. and a humidity of 50%±5%. At the time of measurement, samples were stuck on one another to a thickness of 6 mm or more. A hardness meter (Asker D hardness meter, manufactured by Kobunshi Keiki Co., Ltd.) was used to measure hardness.

(Measurement of Compressibility, Compression Recovery)

A polishing region cut into a circle of 7 mm in diameter (thickness: arbitrary) was used as a sample for measurement of compressibility and compression recovery and left for 40 hours in an environment of a temperature of 23±2° C. and a humidity of 50%±5%. In measurement, a thermal analysis measuring instrument TMA (SS6000, manufactured by SEIKO INSTRUMENTS Inc.) to measure compressibility and compression recovery. Equations for calculating compressibility and compression recovery are shown below.

$$\text{Compressibility (\%)}=\{(T1-T2)/T1\}\times 100$$

T1: the thickness of the polishing layer after the polishing layer in a non-loaded state is loaded with a stress of 30 KPa (300 g/cm$^2$) for 60 seconds.

T2: the thickness of the, polishing layer after the polishing layer allowed to be in the T1 state is loaded with a stress of 180 KPa (1800 g/cm$^2$) for 60 seconds.

$$\text{Compression recovery (\%)}=\{(T3-T2)/(T1-T2)\}\times 100$$

T1: the thickness of the polishing layer after the polishing layer in a non-loaded state is loaded with a stress of 30 KPa (300 g/cm$^2$) for 60 seconds.

T2: the thickness of the polishing layer after the polishing layer allowed to be in the T1 state is loaded with a stress of 180 KPa (1800 g/cm$^2$) for 60 seconds.

T3: the thickness of the polishing layer after the polishing layer after allowed to be in the T2 state is kept without loading for 60 seconds and then loaded with a stress of 30 KPa (300 g/cm$^2$) for 60 seconds.

(Measurement of Storage Elastic Modulus)

Measurement is conducted according to JIS K7198-1991. A polishing region cut into a 3 mm×40 mm strip (thickness: arbitrary) was used as a sample for measurement of dynamic viscoelasticity and left for 4 days in a 23° C. environment condition in a container with silica gel. The accurate width and thickness of each sheet after cutting were measured using a micrometer. For measurement, a dynamic viscoelasticity spectrometer (manufactured by Iwamoto Seisakusho, now IS Giken) was used to determine storage elastic modulus E'. Measurement conditions are as follows:

<Measurement Conditions>

Measurement temperature: 40° C.

Applied strain: 0.03%

Initial loading: 20 g

Frequency: 1 Hz (Evaluation of Film Thickness Detection in the First Invention)

The evaluation of optical detection of film thickness of a wafer was conducted in the following manner. As a wafer, a 1 μm thermal-oxide film was deposited on an 8-inch silicone wafer, and a light-transmitting region member of 1.27 mm in thickness was arranged thereon. The film thickness was measured several times in the wavelength range of 400 to 800 nm by using an interference film thickness measuring instrument (manufactured by Otsuka Electronics Co., Ltd). The result of calculated film thickness and the state of top and bottom of interference light at each wavelength were confirmed, and the film thickness detection was evaluated under the following criteria:

OO: Film thickness is measured with very good reproducibility.

O: Film thickness is measured with good reproducibility.

X: Detection accuracy is insufficient with poor reproducibility.

(Evaluation of Film Thickness Detection in the Second Invention)

The evaluation of optical detection of film thickness of a wafer was conducted in the following manner. As a wafer, a 1 μm thermal-oxide film was deposited on an 8-inch silicone wafer, and a light-transmitting region member of 1.25 mm in thickness was arranged thereon. The film thickness was measured several times at the wavelength of 633 nm with a He—Ne laser in an interference film thickness measuring instrument. The result of calculated film thickness and the state of top and bottom of interference light at each wavelength were confirmed, and the film thickness detection was evaluated under the following criteria:

O: Film thickness is measured with good reproducibility.

X: Detection accuracy is insufficient with poor reproducibility.

(Evaluation of Film Thickness Detection in the Third Invention)

The evaluation of optical detection of film thickness of a wafer was conducted in the following manner. As a wafer, a 1 μm thermal-oxide film was deposited on an 8-inch silicone wafer. Film thickness on a line between a notched portion of the wafer and the center was measured at 33 points at 3-mm intervals by using an interference film thickness measuring instrument (manufactured by Otsuka Electronics Co., Ltd), and the average was indicated as the average film thickness (1). Then, the light-transmitting region of the polishing pad in each of the Examples and Comparative Examples was placed on a wafer so as to be positioned on the above line, and the film thickness was measured at 3-mm intervals by the interface film thickness measuring instrument, and the average was indicated as the average film thickness (2). Then, the average film thickness (1) was compared with the average film thickness (2), and the film thickness detection was evaluated under the following criteria:

O: Film thickness is measured with good reproducibility.

Δ: Film thickness is measured with relatively good reproducibility.

X: Detection accuracy is insufficient with poor reproducibility.

(Method of Measuring the Scatter of Thickness of the Light-transmitting Region)

Using a micrometer (manufactured by Mitutoyo), the thickness of the produced light-transmitting region was measured at 5-mm intervals along a central line in the longitudinal direction. The difference between the maximum and minimum of measurements was indicated as scatter.

(Evaluation of Polishing Characteristics)

The prepared polishing pad was used to evaluate polishing characteristics by using a polishing apparatus SPP600S (manufactured by Okamoto Machine Tool Works, Ltd.). An about 1 μm thermal-oxide film deposited on an 8-inch silicone wafer was polished by about 0.5 μm, and polishing rate was calculated from the time of this polishing. The thickness of the oxide film was measured by using an interference film thickness measuring instrument (manufactured by Otsuka Electronics Co., Ltd). During polishing, silica slurry (SS12 manufactured by Cabot) was added at a flow rate of 150 ml/min. Polishing loading was 350 g/cm$^2$, the number of revolutions of the polishing platen was 35 rpm, and the number of revolutions of the wafer was 30 rpm For evaluation of planarizing characteristics, a 0.5 μm thermal-oxide film was deposited on an 8-inch silicone wafer and subjected to predetermined patterning, and then a 1 μm oxide film of p-TEOS was deposited thereon, to prepare a wafer having a pattern with an initial difference in level of 0.5 μm. This wafer was polished under the above-described conditions, and after polishing, each difference in level was measured to evaluate planarizing characteristics. For planarizing characteristics, two differences in level were measured. One difference is a local difference in level, which is a difference in level in a pattern having lines of 270 μm in width and spaces of 30 μm arranged alternately, and this difference in level after 1 minute was measured. The other difference is an abrasion loss, and in two patterns, that is, a pattern having lines of 270 μm in width and spaces of 30 μm arranged alternately and a pattern having lines of 30 μm in width and spaces of 270 μm arranged alternately, the abrasion loss of 270 μm spaces was measured when the difference in level of the top of the line in the two patterns became 2000 Å or less. A lower local difference in level is indicative of a higher speed of flattening unevenness of the oxide film generated depending on wafer pattern at a certain point in time. A lower abrasion of spaces is indicative of higher planarity with less abrasion of portions desired to be not shaved.

The in-plane uniformity was calculated from the measurement of film thickness at arbitrary 25 points on the wafer. Lower in-plane uniformity is indicative of higher uniformity of wafer surface.

$$\text{In-plane uniformity (\%)} = (\text{maximum film thickness} - \text{minimum film thickness}) / (\text{maximum film thickness} + \text{minimum film thickness})$$

First Invention

Preparation of Light-Transmitting Region

Production Example 1

125 parts by weight of polyester polyol (number-average molecular weight 2440) consisting of adipic acid and hexane diol were mixed with 31 parts by weight of 1,4-butane diol, and the temperature of the mixture was regulated at 70° C. To this mixture were added 100 parts by weight of 4,4'-diphenylmethane diisocyanate previously regulated at a temperature of 70° C., and the mixture was stirred for about 1 minute. The mixture was poured into a container kept at 100° C. and post-cured at 100° C. for 8 hours to prepare polyurethane resin. The prepared polyurethane resin was used to prepare a light-transmitting region (length 57 mm, width 19 mm, thickness 1.25 mm) by injection molding. The light transmittance of the prepared light-transmitting region and the rate of change thereof are shown in Table 1.

Production Example 2

A light-transmitting region (length 57 mm, width 19 mm, thickness 1.25 mm) was prepared in the same manner as in Production Example 1 except that 77 parts by weight of polyester polyol (number-average molecular weight 1920) consisting of adipic acid and hexane diol was used, and the amount of 1,4-butane diol was changed to 32 parts by weight. The light transmittance of the prepared light-transmitting region and the rate of change thereof are shown in Table 1.

Production Example 3

A light-transmitting region (length 57 mm, width 19 mm, thickness 1.25 mm) was prepared in the same manner as in Production Example 1 except that 114 parts by weight of polytetramethylene glycol (number-average molecular weight 890) was used as the polyol, and the amount of 1,4-butane diol was changed to 24 parts by weight. The light transmittance of the prepared light-transmitting region and the rate of change thereof are shown in Table 1.

Production Example 4

100 parts by weight of an isocyanate-terminated prepolymer (L-325, NCO content of 9.15 wt %, manufactured by Uniroyal Chemical) regulated at a temperature of 70° C. were measured out in a vacuum tank, and gas remaining in the prepolymer was removed under reduced pressure (about 10 Torr). 26 parts by weight of 4,4'-methylene bis(o-chloroaniline) previously melted at 120° C. (IHARA CUAMINE MT manufactured by Ihara Chemical Industry Co., Ltd.) were added to the above degassed prepolymer which was then mixed under stirring in a hybrid mixer (Manufactured by KEYENCE Corporation). Then, the mixture was poured into a mold and post-cured for 8 hours in an oven at 110° C. to prepare a light-transmitting region (length 57 mm, width 19 mm, thickness 1.25 mm). The light transmittance of the prepared light-transmitting region and the rate of change thereof are shown in Table 1.

[Preparation of Polishing Region]

100 parts by weight of a filtered polyether-based prepolymer (Adiprene L-325, NCO content of 2.22 meq/g, manufactured by Uniroyal Chemical) and 3 parts by weight of a filtered silicone-based nonionic surfactant (SH192 manufactured by Toray Dow Corning Silicone Co., Ltd.) were introduced into a reaction container coated with fluorine, and the temperature was regulated at 80° C. The mixture was stirred vigorously for about 4 minutes at a revolution number of 900 rpm by a fluorine-coated stirring blade to incorporate bubbles into the reaction system. 26 parts by weight of filtered 4,4'-methylene bis(o-chloroaniline) previously melted at 120° C. (IHARA CUAMINE MT manufactured by Ihara Chemical Industry Co., Ltd.) were added thereto. Thereafter, the reaction solution was stirred for about 1 minute and poured into a pan-type open mold coated with fluorine. When the fluidity of this reaction solution was lost, the reaction solution was introduced into an oven and post-cured at 110° C. for 6 hours to give a polyurethane resin foam block. This polyurethane resin foam block was sliced by a bandsaw-type slicer (manufactured by Fecken) to give a polyurethane resin foam sheet. Then, this sheet was surface-buffed to predetermined thickness by a buffing machine (manufactured by Amitec) to give a sheet having regulated thickness accuracy (sheet thickness, 1.27 mm). This buffed sheet was cut into a round sheet having a predetermined diameter (61 cm) and provided with grooves in the form of concentric circles having a groove width of 0.25 mm, a groove pitch of 1.50 mm and a groove depth of 0.40 mm by using a grooving machine (manufactured by TohoKoki Co., Ltd.). A double-coated tape (Double Tack Tape, manufactured by Sekisui Chemical Co., Ltd.) was stuck by a laminator on the other side than the grooved surface of this sheet, and thereafter, a hole (thickness 1.27 mm, 57.5 mm×19.5 mm) for inserting a light-transmitting region into a predetermined position of the grooved sheet was punched out, to prepare a polishing region provided with the double-coated tape. Physical properties of the prepared polishing region were as follows: average cell diameter, 45 μm; specific gravity, 0.86 g/cm$^3$; Asker D hardness, 53°; compressibility, 1.0%; compression recovery, 65.0%; and storage elastic modulus, 275 MPa.

Preparation of Polishing Pad

Example 1

A cushion layer consisting of polyethylene foam (Toray Peff, thickness of 0.8 mm, manufactured by Toray Industries, Inc.) having a surface brushed with a buff and subjected to corona treatment was stuck by a laminator on the pressure-sensitive adhesive surface of a double-coated tape provided with the polishing region. Further, the double-coated tape was stuck on the surface of the cushion layer. Thereafter, the cushion layer was punched out with a size of 51 mm×13 mm in the punched hole of the polishing region for inserting a light-transmitting region, to penetrate the hole. Thereafter, the light-transmitting region prepared in Production Example 1 was inserted into the hole to prepare a polishing pad. The physical properties etc. of the prepared polishing pad are shown in Table 1.

Example 2

A polishing pad was prepared in the same manner as in Example 1 except that the light-transmitting region prepared in Production Example 2 was used. The physical properties etc. of the prepared polishing pad are shown in Table 1.

Example 3

A polishing pad was prepared in the same manner as in Example 1 except that the light-transmitting region prepared in Production Example 3 was used. The physical properties etc. of the prepared polishing pad are shown in Table 1.

Comparative Example 1

A polishing pad was prepared in the same manner as in Example 1 except that the light-transmitting region prepared in Production Example 4 was used. The physical properties etc. of the prepared polishing pad are shown in Table 1.

TABLE 1

| | Light transmittance (%) | | | | Maximum transmittance | Minimum transmittance | Rate of | Polishing rate | Local difference | Abrasion | Detection of film |
|---|---|---|---|---|---|---|---|---|---|---|---|
| | 400 nm | 500 nm | 600 nm | 700 nm | (%) | (%) | change (%) | (Å/min) | in level (Å) | loss (Å) | thickness |
| Example 1 | 71.5 | 96.5 | 96.9 | 95.5 | 97.1 | 71.5 | 26.4 | 2300 | 20 | 2900 | ○○ |
| Example 2 | 77.9 | 95.0 | 94.8 | 93.3 | 95.1 | 77.9 | 18.1 | 2400 | 10 | 3000 | ○○ |
| Example 3 | 51.4 | 96.9 | 96.8 | 95.3 | 97.2 | 51.4 | 47.1 | 2300 | 20 | 3000 | ○ |
| Comparative Example 1 | 14.7 | 85.4 | 92.9 | 93.9 | 94.1 | 14.7 | 84.4 | 2350 | 20 | 2950 | X |

From Table 1, it can be seen that when the transmittance of the light-transmitting region in wavelengths of 400 to 700 nm is 50% or more (Examples 1 to 3), the endpoint of a wafer can be detected with good reproducibility without influencing polishing characteristics.

Second Invention

Preparation of Light-Transmitting Region

Production Example 5

150 parts by weight of an isocyanate-terminated prepolymer (L-325, NCO content of 9.15 wt %, manufactured by Uniroyal Chemical) regulated at a temperature of 70° C. were measured out in a vacuum tank, and gas remaining in the prepolymer was removed under reduced pressure (about 10 Torr). 39 parts by weight of 4,4'-methylene bis(o-chloroaniline) previously melted at 120° C. (IHARA CUAMINE MT manufactured by Ihara Chemical Industry Co., Ltd.) were added to the above degassed prepolymer which was then stirred at a revolution number of 800 rpm for 3 minutes with a rotating mixer (manufactured by Thinky). Then, the mixture was poured into a mold and post-cured for 8 hours in an oven at 110° C. to prepare a light-transmitting region member.

Then, a light-transmitting region (length 57 mm, width 19 mm, thickness 1.25 mm) was cut off from the light-transmitting region member. When observed with naked eyes, there were no bubbles in the light-transmitting region. The transmittance of the prepared light-transmitting region is shown in Table 2.

Production Example 6

1000 parts by weight of toluene diisocyanate (mixture of 2,4-diisocyanate/2,6-diisocyanate in a ratio of 80/20), 168 parts by weight of 4,4'-dicyclohexyl methane diisocyanate, 1678 parts by weight of polytetramethylene glycol (number-average molecular weight: 1012) and 150 parts by weight of 1,4-butane diol were mixed and heated at 80° C. for 150 minutes under stirring to prepare an isocyanate-terminated prepolymer (isocyanate equivalent: 2.20 meq/g). 100 parts by weight of this prepolymer were measured out in a vacuum tank, and gas remaining in the prepolymer was removed under reduced pressure (about 10 Torr). 29 parts by weight of the above 4,4'-methylene bis(o-chloroaniline) previously melted at 120° C. were added to the above degassed prepolymer which was then stirred at a revolution number of 800 rpm for 3 minutes with a rotating mixer (manufactured by Thinky). Then, the mixture was poured into a mold and post-cured for 8 hours in an oven at 110° C. to prepare a light-transmitting region member. Then, a light-transmitting region (length 57 mm, width 19 mm, thickness 1.25 mm) was cut off from the light-transmitting region member. When observed with naked eyes, there were no bubbles in the light-transmitting region. The transmittance of the prepared light-transmitting region is shown in Table 2.

Production Example 7

120 parts by weight of polyester polyol (number-average molecular weight 2440) consisting of adipic acid and hexane diol were mixed with 30 parts by weight of 1,4-butane diol, and the temperature of the mixture was regulated at 70° C. To this mixture were added 100 parts by weight of 4,4'-diphenyl methane diisocyanate previously regulated at a temperature of 70° C., and the resulting mixture was stirred at a revolution number of 500 rpm for 1 minute with a hybrid mixer (manufactured by KEYENCE Corporation). Then, the mixture was poured into a container kept at 100° C. and then post-cured at 100° C. for 8 hours to prepare polyurethane resin. The prepared polyurethane resin was used to prepare a light-transmitting region member by injection molding. Then, a light-transmitting region (length 57 mm, width 19 mm, thickness 1.25 mm) was cut off from the light-transmitting region member. When observed with naked eyes, bubbles were slightly contained in the light-transmitting region. The transmittance of the prepared light-transmitting region is shown in Table 2.

[Preparation of Polishing Region]

100 parts by weight of a filtered polyether-based prepolymer (Adiprene L-325, NCO content of 2.22 meq/g, manufactured by Uniroyal Chemical) and 3 parts by weight of a filtered silicone-based nonionic surfactant (SH192 manufactured by Toray Dow Corning Silicone Co., Ltd.) were mixed in a reaction container coated with fluorine, and the temperature was regulated at 80° C. The mixture was stirred vigorously for about 4 minutes at a revolution number of 900 rpm by a fluorine-coated stirring blade to incorporate bubbles into the reaction system. 26 parts by weight of filtered 4,4'-methylene bis(o-chloroaniline) previously melted at 120° C. (IHARA CUAMINE MT manufactured by Ihara Chemical Industry Co., Ltd.) were added thereto. Thereafter, the reaction solution was stirred for about 1 minute and poured into a pan-type open mold coated with fluorine. When the fluidity of this reaction solution was lost, the reaction solution was introduced into an oven and post-cured at 110° C. for 6 hours to give a polyurethane resin foam block. This polyurethane resin foam block was sliced by a handsaw-type slicer (manufactured by Fecken) to give a polyurethane resin foam sheet. Then, this sheet was surface-buffed to predetermined thickness by a buffing machine (manufactured by Amitec) to give a sheet having regulated thickness accuracy (sheet thickness, 1.27 mm). This buffed sheet was cut into a round sheet having a predetermined diameter (61 cm) and provided with grooves in the form of concentric circles having a groove width of 0.25 mm, a groove pitch of 1.50 mm and a groove depth of 0.40 mm by a grooving machine (TohoKoki Co., Ltd.). A double-coated tape (Double Tack Tape, manufactured by Sekisui Chemical Co., Ltd.) was stuck by a laminator on the other side than the grooved surface of this sheet, and thereafter, a hole (thickness 1.27 mm, 57.5 mm×19.5 mm) for inserting a light-transmitting region into a predetermined position of the grooved sheet was punched out, to prepare a polishing region provided with the double-coated tape. Physical properties of the prepared region were as follows: average cell diameter, 45 Elm; specific gravity, 0.86 g/cm$^3$; Asker D hardness, 53°; compressibility, 1.0%; compression recovery, 65.0%; and storage elastic modulus, 275 MPa.

Preparation of Polishing Pad

Example 4

A cushion layer consisting of polyethylene foam (Toray Pef, thickness of 0.8 mm, manufactured by Toray Industries, Inc.) having a surface brushed with a buff and subjected to corona treatment was stuck by a laminator on the pressure-sensitive adhesive surface of the double-coated tape provided with the polishing region. Further, the double-coated tape was stuck on the surface of the cushion layer. Thereafter, the cushion layer was punched out with a size of 51 mm×13 mm in the punched hole of the polishing region for inserting a light-transmitting region, to penetrate the hole. Thereafter, the light-transmitting region prepared in Production Example 5 was inserted into the hole to prepare a polishing pad. The physical properties etc. of the prepared polishing pad are shown in Table 2.

Example 5

A polishing pad was prepared in the same manner as in Example 4 except that the light-transmitting region prepared in Production Example 6 was used. The physical properties etc. of the prepared polishing pad are shown in Table 2.

Comparative Example 2

A polishing pad was prepared in the same manner as in Example 4 except that the light-transmitting region prepared in Production Example 7 was used. The physical properties etc. of the prepared polishing pad are shown in Table 2.

TABLE 2

| | Light Transmittance (%) | | | Polishing rate | Local difference | Space abrasion | Detection of |
|---|---|---|---|---|---|---|---|
| | 600 nm | 650 nm | 700 nm | (Å/min) | in level (Å) | loss (Å) | film thickness |
| Example 4 | 92.9 | 93.1 | 93.9 | 2250 | 15 | 2900 | ○ |
| Example 5 | 92.5 | 92.7 | 93.1 | 2200 | 20 | 3000 | ○ |
| Comparative Example 2 | 74.5 | 75.1 | 75.4 | 2300 | 60 | 2950 | X |

From Table 2, it can be seen that when the light transmittance of the light-transmitting region in wavelengths of 600 to 700 nm is 80% or more (Examples 4 and 5), the endpoint of a wafer can be detected with good reproducibility without influencing polishing characteristics.

Third Invention

Preparation of Light-Transmitting Region

Production Example 8

50 parts by weight of an isocyanate-terminated prepolymer (L-325, NCO content of 9.15 wt %, manufactured by Uniroyal Chemical) regulated at a temperature of 70° C. were measured out in a vacuum tank, and gas remaining in the prepolymer was removed under reduced pressure (about 10 Torr). 13 parts by weight of 4,4'-methylene bis(o-chloroaniline) previously melted at 120° C. (IHARA CUAMINE MT manufactured by Ihara Chemical Industry Co., Ltd.) were added to the above degassed prepolymer which was then stirred for 1 minute with a hybrid mixer (manufactured by KEYENCE Corporation), to degas the mixture. Then, the mixture was poured into a mold and post-cured in an oven at 110° C. for 8 hours to prepare a rectangular light-transmitting region (length 57 mm, width 19 mm, thickness 1.25 mm). The difference in scatter of the thickness of the light-transmitting region was 107 μm.

Production Example 9

A light-transmitting region was prepared in the same manner as in Production Example 8 except that the shape of the light-transmitting region was rectangular with a length of 100 mm, a width of 19 mm and a thickness of 1.25 mm.

Production Example 10

A light-transmitting region (length 57 mm, width 19 mm and thickness 1.25 mm) was prepared in the same manner as in Production Example 8. Then, the light-transmitting region was buffed with 240-size sandpaper. The difference in scatter of the thickness of the light-transmitting region, when measured thereafter, was 45 μm.

Production Example 11

A light-transmitting region (length 57 mm, width 19 mm and thickness 1.25 mm) was prepared in the same manner as in Production Example 8. Then, the light-transmitting region was buffed with 240-size sandpaper and further buffed with 800-size sandpaper in an analogous manner. The difference in scatter of the thickness of the light-transmitting region, when measured thereafter, was 28 μm.

Production Example 12

A light-transmitting region was prepared in the same manner as in Production Example 8 except that the shape of the light-transmitting region was circular with a diameter of 30 mm.

Production Example 13

A light-transmitting region was prepared in the same manner as in Production Example 8 except that the shape of the light-transmitting region was rectangular with a length of 50.8 mm, a width of 20.3 mm and a thickness of 1.25 mm.

[Preparation of Polishing Region]

1000 parts by weight of a filtered polyether-based prepolymer (Adiprene L-325, NCO content of 2.22 meq/g, manufactured by Uniroyal Chemical) and 30 parts by weight of a filtered silicone-based nonionic surfactant (SH192 manufactured by Toray Dow Corning Silicone Co., Ltd.) were mixed in a reaction container coated with fluorine, and the temperature was regulated at 80° C. The mixture was stirred vigorously for about 4 minutes at a revolution number of 900 rpm by a fluorine-coated stirring blade to incorporate bubbles into the reaction system. 260 parts by weight of filtered 4,4'-methylene bis(o-chloroaniline) previously melted at 120° C. (IHARA CUAMINE MT manufactured by Ihara Chemical Industry Co., Ltd.) were added thereto. Thereafter, the reaction solution was stirred for about 1 minute and poured into a pan-type open mold coated with fluorine. When the fluidity of this reaction solution was lost, the reaction solution was introduced into an oven and post-cured at 110° C. for 6 hours to give a polyurethane resin foam block. This polyurethane resin foam block was sliced by a handsaw-type slicer (manufactured by Fecken) to give a polyurethane resin foam sheet. Then, this sheet was surface-buffed to predetermined thickness by a buffing machine (manufactured by Amitec) to give a sheet having regulated thickness accuracy (sheet thickness, 1.27 mm). This buffed sheet was punched out to give a round sheet having a predetermined diameter (61 cm) which was then provided with grooves in the form of concentric circles having a groove width of 0.25 mm, a groove pitch of 1.50 mm and a groove depth of 0.40 mm by a grooving machine (manufactured by TohoKoki Co., Ltd.). A double-coated tape (Double Tack Tape, manufactured by Sekisui Chemical Co., Ltd.) was stuck by a laminator on the other side than the grooved surface of this sheet, to prepare a polishing region provided with the double-coated tape. Physical properties of the polishing region were as follows: average cell diameter, 50 μm; specific gravity, 0.86 g/cm$^3$; Asker D hardness, 52°;

compressibility, 1.1%; compression recovery, 65.0%; and storage elastic modulus, 260 MPa.

Preparation of Polishing Pad

Example 6

A hole (rectangular, D (diametrical direction)=57.5 mm, L (circumferential direction)=19.5 mm) for inserting a light-transmitting region into between the central portion and the peripheral portion of the polishing region provided with a double-coated tape was punched out. Then, a cushion layer consisting of polyethylene foam (Toray Pef, thickness of 0.8 mm, manufactured by Toray Industries, Inc.) having a surface brushed with a buff and subjected to corona treatment was stuck by a laminator on the pressure-sensitive adhesive surface of the double-coated tape provided with the polishing region. Further, the double-coated tape was stuck on the surface of the cushion layer. Thereafter, the cushion layer was punched out with a size (rectangular, D (diametrical direction)=51 mm, L (circumferential direction)=13 mm) in the punched hole of the polishing region for inserting a light-transmitting region, to penetrate the hole. Thereafter, the light-transmitting region prepared in Production Example 8 was inserted into the hole to prepare a polishing pad as shown in FIG. 4. The length (D) of the light-transmitting region in the diametrical direction is 3 times as long as the length (L) in the circumferential direction. The ratio of the length (D) of the light-transmitting region in the diametrical direction to the diameter of a wafer as an object of polishing was 0.28. The physical properties of the prepared polishing pad are shown in Table 3.

Example 7

A hole (rectangular, D (diametrical direction)=100.5 mm, L (circumferential direction)=19.5 mm) for inserting a light-transmitting region into between the central portion and the peripheral portion of the polishing region provided with a double-coated tape was punched out. Then, a cushion layer consisting of polyethylene foam (Toray Pef, thickness of 0.8 mm, manufactured by Toray Industries, Inc.) having a surface brushed with a buff and subjected to corona treatment was stuck by a laminator on the pressure-sensitive adhesive surface of the double-coated tape provided with the polishing region. Further, the double-coated tape was stuck on the surface of the cushion layer. Thereafter, the cushion layer was punched out with a size (rectangular, D (diametrical direction)=94 mm, L (circumferential direction)=13 mm) in the punched hole of the polishing region for inserting a light-transmitting region, to penetrate the hole. Thereafter, the light-transmitting region prepared in Production Example 9 was inserted into the hole to prepare a polishing pad as shown in FIG. 4. The length (D) of the light-transmitting region in the diametrical direction is 5.3 times as long as the length (L) in the circumferential direction. The ratio of the length (D) of the light-transmitting region in the diametrical direction to the diameter of a wafer as an object of polishing was 0.49. The physical properties of the prepared polishing pad are shown in Table 3.

Example 8

A polishing pad was prepared in the same manner as in Example 6 except that the light-transmitting region prepared in Production Example 10 was used in place of the light-transmitting region prepared in Production Example 8. The physical properties of the prepared polishing pad are shown in Table 3.

Example 9

A polishing pad was prepared in the same manner as in Example 6 except that the light-transmitting region prepared in Production Example 11 was used in place of the light-transmitting region prepared in Production Example 8. The physical properties of the prepared polishing pad are shown in Table 3.

Comparative Example 3

Figure 11:
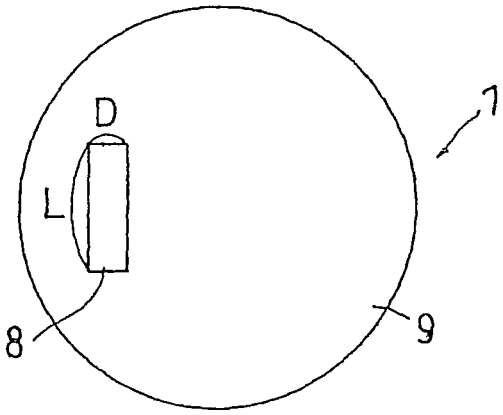
FIG. 11 is a schematic view showing the polishing pad in Comparative Example 3.
Figure 12:
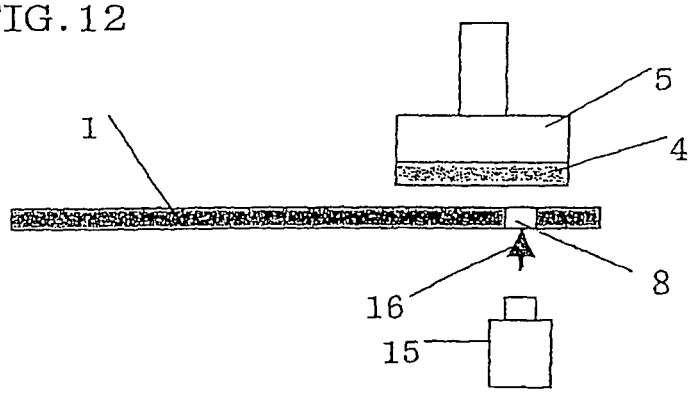
FIG. 12 is a schematic illustration showing one example of a CMP polishing apparatus having the endpoint sensing apparatus of the present invention.

A hole (rectangular, D (diametrical direction)=19.5 mm, L (circumferential direction)=57.5 mm) for inserting a light-transmitting region into between the central portion and the peripheral portion of the polishing region provided with a double-coated tape was punched out. Then, a cushion layer consisting of polyethylene foam (Toray Pef, thickness of 0.8 mm, manufactured by Toray Industries, Inc.) having a surface brushed with a buff and subjected to corona treatment was stuck by a laminator on the pressure-sensitive adhesive surface of the double-coated tape provided with the polishing region. Further, the double-coated tape was stuck on the surface of the cushion layer. Thereafter, the cushion layer was punched out with a size (rectangular, D (diametrical direction)=13 mm, L (circumferential direction)=51 mm) in the punched hole of the polishing region for inserting a light-transmitting region, to penetrate the hole. Thereafter, the light-transmitting region prepared in Production Example 8 was inserted into the hole to prepare a polishing pad as shown in FIG. 11. The length (D) of the light-transmitting region in the diametrical direction is 0.3 relative to the length (L) in the circumferential direction. The ratio of the length (D) of the light-transmitting region in the diametrical direction to the diameter of a wafer as an object of polishing was 0.09. The physical properties of the prepared polishing pad are shown in Table 3.

Comparative Example 4

Figure 3:
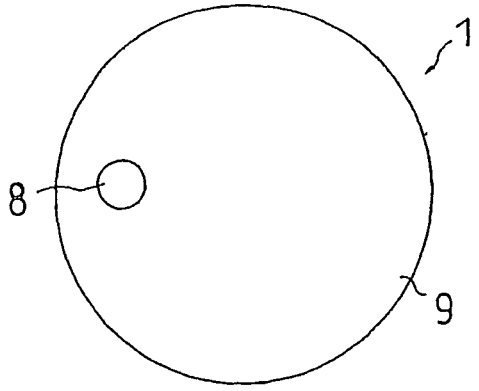
FIG. 3 is a schematic view showing another example of a polishing pad having a conventional light-transmitting region.

A hole (circle, diameter 30.5 mm) for inserting a light-transmitting region into between the central portion and the peripheral portion of the polishing region provided with a double-coated tape was punched out. Then, a cushion layer consisting of polyethylene foam (Toray Pef, thickness of 0.8 mm, manufactured by Toray Industries, Inc.) having a surface brushed with a buff and subjected to corona treatment was stuck by a laminator on the pressure-sensitive adhesive surface of the double-coated tape provided with the polishing region. Further, the double-coated tape was stuck on the surface of the cushion layer. Thereafter, the cushion layer was punched out with a size of a diameter of 24 mm in the punched hole of the polishing region for inserting a light-transmitting region, to penetrate the hole. Thereafter, the light-transmitting region prepared in Production Example 12 was inserted into the hole to prepare a polishing pad as shown in FIG. 3. The length of the light-transmitting region is 0.15 relative to the length of a wafer as an object of polishing. The physical properties of the prepared polishing pad are shown in Table 3.

Comparative Example 5

A hole (rectangular, D (diametrical direction)=51.3 mm, L (circumferential direction)=20.8 mm) for inserting a light-transmitting region into between the central portion and the peripheral portion of the polishing region provided with a double-coated tape was punched out. Then, a cushion layer consisting of polyethylene foam (Toray Pef, thickness of 0.8 mm, manufactured by Toray Industries, Inc.) having a surface brushed with a buff and subjected to corona treatment was stuck by a laminator on the pressure-sensitive adhesive surface of the double-coated tape provided with the polishing region. Further, the double-coated tape was stuck on the surface of the cushion layer. Thereafter, the cushion layer was punched out with a size (rectangular, D (diametrical direction)=44.8 mm, L (circumferential direction)=14.3 mm) in the punched hole of the polishing region for inserting a light-transmitting region, to penetrate the hole. Thereafter, the light-transmitting region prepared in Production Example 13 was inserted into the hole to prepare a polishing pad as shown in FIG. 4. The length (D) of the light-transmitting region in the diametrical direction is 2.5 times as long as the length (L) in the circumferential direction. The ratio of the length (D) of the light-transmitting region in the diametrical direction to the diameter of a wafer as an object of polishing was 0.25. The physical properties of the prepared polishing pad are shown in Table 3.

TABLE 3

| | Polishing rate (Å/min) | In-plane uniformity (%) | Detection of film thickness |
|---|---|---|---|
| Example 6 | 2450 | 7 | ○ |
| Example 7 | 2350 | 5 | ○ |
| Example 8 | 2450 | 5 | ○ |
| Example 9 | 2450 | 4 | ○ |
| Comparative Example 3 | 2330 | 13 | X |
| Comparative Example 4 | 2400 | 11 | X |
| Comparative Example 5 | 2430 | 8.5 | Δ |

From Table 3, it can be seen that when the length (D) of the light-transmitting region in the diametrical direction is 3 times or more longer than the length (L) in the circumferential direction (Examples 6 to 9), the light-transmitting region contacts uniformly with the whole surface of a wafer during polishing without contacting intensively with only a certain part of the wafer, and thus the wafer can be uniformly polished to improve polishing characteristics (particularly in-plane uniformity). When the scatter of the thickness of the light-transmitting region is decreased, the in-plane uniformity can be improved (Examples 8 and 9).

INDUSTRIAL APPLICABILITY

The polishing pad of the present invention is used in planarizing an uneven surface of a wafer by chemical mechanical polishing (CMP). Specifically, the present invention relates to a polishing pad having a window for detecting a polishing state etc. by an optical means.

The invention claimed is:

1. An apparatus for chemical mechanical polishing in combination with a polishing pad and material to be polished, comprising said material to be polished and the polishing pad used in chemical mechanical polishing and having a polishing region and a light-transmitting region, said polishing pad having the following characteristics: i) light transmittance in the light-transmitting region throughout the wavelength range of 400 to 700 nm is 70% or more; and ii) a thickness of the light-transmitting region is 0.5 to 4 mm, and light transmittance in the light-transmitting region throughout the wavelength range of 500 to 700 nm is 90% or more;

wherein the light-transmitting region is arranged between a central portion and a peripheral portion of the polishing pad, and a length (D) of the light transmitting region in a diametrical direction is 3 times or more longer than a length (L) in a circumferential direction, wherein a length (D) in a diametrical direction is ¼ to ½ relative to the diameter of a material to be polished, and a scatter of the thickness of the light-transmitting region is 100 μm or less wherein materials for forming the polishing region and the light-transmitting region are polyurethane resin, and the polyurethane resin as the material for forming the polishing region and the polyurethane resin as the material for forming the light-transmitting region are different materials but produced from the same kinds of organic isocyanate, polyol and chain extender, and wherein the polyurethane resin as the material for forming the light-transmitting region does not contain aromatic polyamine and the material for forming the light transmitting region is non-foam, wherein a material for forming the polishing region is fine-cell foam, and wherein a rate of change of the light transmittance in the light-transmitting region in wavelengths of 400 to 700 nm represented by the following equation is 30% or less:

the rate of change (%)={(maximum transmittance in 400 to 700 nm−minimum transmittance in 400 to 700 nm)/maximum transmittance in 400 to 700 nm}×100.

2. The polishing pad according to any one of claim 1, wherein a difference among respective light transmittances in the light-transmitting region in 500 to 700 nm is 5% or less.

3. The polishing pad according to claim 1, wherein a shape of the light-transmitting region is rectangular.

4. The polishing pad according to claim 1, which does not have an uneven structure for retaining and renewing an abrasive liquid on a surface of the light-transmitting region on a polishing side.

5. The polishing pad according to claim 1, wherein a surface of the polishing region on a polishing side is provided with grooves.

6. The polishing pad according to claim 1, wherein an average cell diameter of the fine-cell foam is 70 μm or less.

7. The polishing pad according to claim 1, wherein a specific gravity of the fine-cell foam is 0.5 to 1.0 g/cm$^3$.

8. The polishing pad according to claim 1, wherein a hardness of the fine-cell foam is 45 to 65° in terms of Asker D hardness.

9. The polishing pad according to claim 1, wherein a compressibility of the fine-cell foam is 0.5 to 5.0%.

10. An apparatus for chemical mechanical polishing in combination with a polishing pad and material to be polished, comprising said material to be polished and the polishing pad used in chemical mechanical polishing and having a polishing region and a light-transmitting region, said polishing pad having the following characteristics: i) light transmittance in the light-transmitting region throughout the wavelength range of 400 to 700 nm is 70% or more; and ii) a thickness of the light-transmitting region is 0.5 to 4 mm, and light transmittance in the light-transmitting region throughout the wavelength range of 500 to 700 nm is 90% or more;

wherein the light-transmitting region is arranged between a central portion and a peripheral portion of the polishing pad, and a length (D) of the light transmitting region in a diametrical direction is 3 times or more longer than a length (L) in a circumferential direction, wherein a length (D) in a diametrical direction is ¼ to ½ relative to the diameter of a material to be polished, and a material for forming the polishing region is fine-cell foam, wherein a compression recovery of the fine-cell foam is 50 to 100% wherein materials for forming the polishing region and the light-transmitting region are polyurethane resin, and the polyurethane resin as the material for forming the polishing region and the polyurethane resin as the material for forming the light-transmitting region are different materials but produced from the same kinds of organic isocyanate, polyol and chain extender, wherein the polyurethane resin as the material for forming the light-transmitting region does not contain aromatic polyamine and the material for forming the light transmitting region is non-foam, and wherein a rate of change of the light transmittance in the light-transmitting region in wavelengths of 400 to 700 nm represented by the following equation is 30% or less:

the rate of change (%)={(maximum transmittance in 400 to 700 nm−minimum transmittance in 400 to 700 nm)/maximum transmittance in 400 to 700 nm}×100.

11. The polishing pad according to claim 1, wherein a storage elastic modulus of the fine-cell foam at 40° C. at 1 Hz is 200 MPa or more.

* * * * *

UNITED STATES PATENT AND TRADEMARK OFFICE

CERTIFICATE OF CORRECTION

PATENT NO. : 8,845,852 B2
APPLICATION NO. : 10/536621
DATED : September 30, 2014
INVENTOR(S) : Nakamori et al.

It is certified that error appears in the above-identified patent and that said Letters Patent is hereby corrected as shown below:

In the Specification

In column 1 at line 5 (approx.), Change "PCT/JP2003/.015128," to --PCT/JP2003/015128,--.

In column 5 at line 57, Change "grater" to --greater--.

In column 9 at line 1, Change "1,4-cyclohexan" to --1,4-cyclohexane--.

In column 10 at line 25, Change "planing" to --planning--.

In column 11 at line 1, Change "Is easily" to --is easily--.

In column 13 at line 67, Change "transfered" to --transferred--.

In column 14 at line 37, Change "planing" to --planning--.

In column 17 at line 5 (approx.), Change "Spectra Photometer," to --Spectrophotometer,--.

In column 17 at line 15 (approx.), Change "Spectra Photometer," to --Spectrophotometer,--.

In column 17 at line 27, Change "Toyobouseki" to --Toyo Boseki--.

In column 18 at line 41, Change "OO:" to --○:--.

In column 18 at line 43, Change "O:" to --○:--.

In column 18 at line 59, Change "O:" to --○:--.

In column 19 at line 14, Change "O:" to --○:--.

In column 19 at line 39, Change "rpm" to --rpm.--.

In column 21 at line 64, Change "Peff," to --Pef,--.

In column 24 at line 30 (approx.), Change "Elm;" to --μm;--.

In the Claims

In column 30 at line 32 (approx.), In Claim 2, after "to" delete "any one of".

Signed and Sealed this
Twenty-first Day of July, 2015

Michelle K. Lee

Michelle K. Lee
*Director of the United States Patent and Trademark Office*